United States Patent [19]

Higashimura et al.

[11] Patent Number: 4,948,692

[45] Date of Patent: Aug. 14, 1990

[54] COMBINATION TONER AND PRINTER UTILIZING SAME

[75] Inventors: Koichi Higashimura; Yoshinori Miyazawa; Tsuneo Handa; Teruyuki Mizumoto; Hiroshi Ito; Atsushi Uchino; Masanobu Motoki; Masanao Kunugi; Tahei Ishiwatari; Hidetsugu Shimura, all of Nagano, Japan

[73] Assignee: Seiko Epson Corporation, Tokyo, Japan

[21] Appl. No.: 189,903

[22] Filed: May 3, 1988

Related U.S. Application Data

[63] Continuation of Ser. No. 33,135, Mar. 31, 1987, abandoned.

[30] Foreign Application Priority Data

| | | | |
|---|---|---|---|
| Mar. 31, 1986 | [JP] | Japan | 61-073266 |
| Apr. 30, 1986 | [JP] | Japan | 61-100167 |
| Jul. 3, 1986 | [JP] | Japan | 61-156706 |
| Nov. 27, 1986 | [JP] | Japan | 61-282277 |

[51] Int. Cl.[5] ..... G03G 9/087

[52] U.S. Cl. ..... 430/106.6; 430/126; 430/137

[58] Field of Search ..... 430/31, 97, 110, 120, 430/111, 106.6, 126, 137

[56] References Cited

U.S. PATENT DOCUMENTS

| | | | |
|---|---|---|---|
| 4,254,203 | 3/1981 | Oka et al. | 430/111 |
| 4,273,848 | 6/1981 | Inagaki et al. | 430/111 |
| 4,555,467 | 11/1985 | Hasegawa et al. | 430/110 |
| 4,647,522 | 3/1987 | Lu | 430/110 |
| 4,693,951 | 9/1987 | Takasu et al. | 430/31 |

*Primary Examiner*—John L. Goodrow
*Attorney, Agent, or Firm*—Blum Kaplan

[57] ABSTRACT

A combination toner for xerographic image formation having conductive portions and insulating portions is provided. The conductive portions function to accumulate a charge in the toner particles and the insulating portions function to lengthen the period of discharge of the accumulated charge. The toner can be either magnetic or non-magnetic and improves image formation and transfer.

19 Claims, 27 Drawing Sheets

FIG. 2A
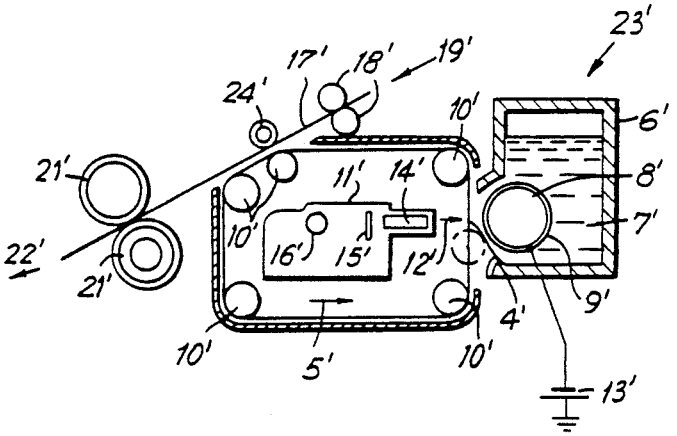
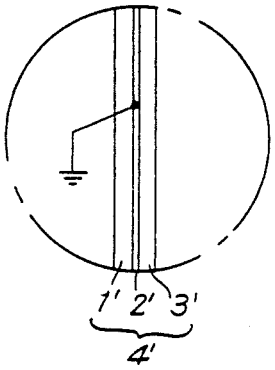
FIG. 2B

FIG. 3A
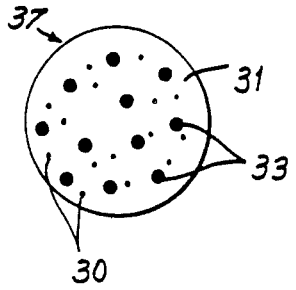
FIG. 3B
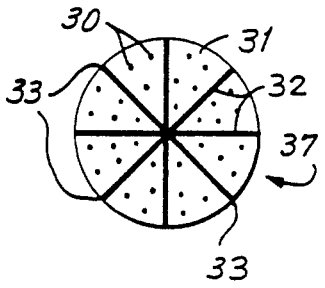
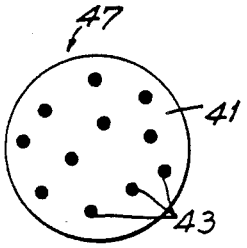
FIG. 4A
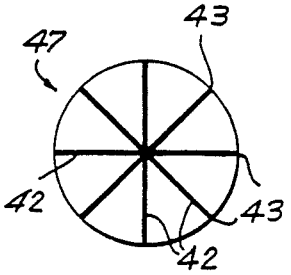
FIG. 4B

FIG. 48
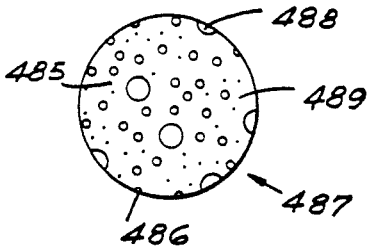
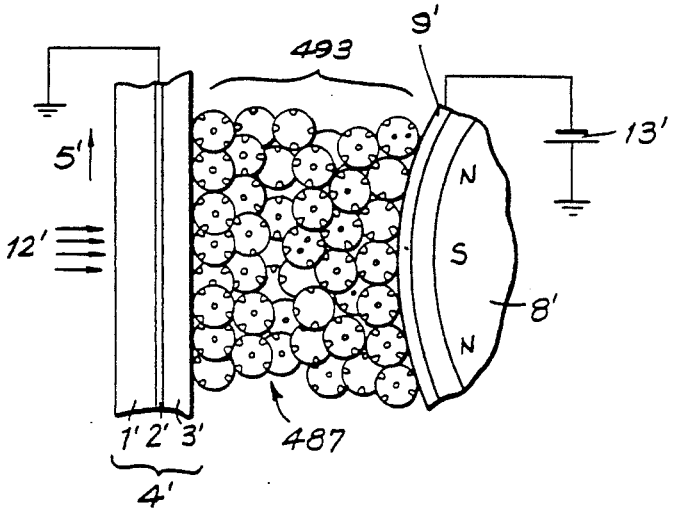
FIG. 49

COMBINATION TONER AND PRINTER UTILIZING SAME

This is a continuation of application Ser. No. 033,135, filed Mar. 31, 1987, now abandoned.

BACKGROUND OF THE INVENTION

The present invention relates to toners for use in printers employing xerography techniques and, more particularly, to an improved combination toner for use in a xerography printer that permits improved transfer to developed images.

The term "xerography" as used herein refers to a dry photographic or photocopying process in which a negative image is formed on an electrically charged plate by a resinous powder and is electrically transferred to and thermally fixed as a positive image on a paper or other copying surface. Various types of printers utilizing xerography techniques have been developed.

Three types of toners are generally used for xerography printing. In printers utilizing "Carlson's process" insulating non-magnetic toners are used for Two-Component Magnetic Brush Developing as well as for Floating Electrode Effect Developing (FEED). Alternatively, insulating magnetic toners are used in the Jamping Developing Method and conductive magnetic toners are used in electrofacsimile machines.

Xerography techniques have been improved to a point that exposure and developement can be performed simultaneously to create images. This method is referred to as Direct Developing Process (DDP) and is a process that promises to greatly simplify image development. An example of such a technique is disclosed in Japanese Patent Laid Open Application No. 58-153957.

The best DDP image forming method requires the surface of an image forming member having a photoelectric conductive layer to be swept with a brush of conductive magnetic toner to which a bias voltage has been applied. The electric charge carried by the toner is different in the unexposed portion of the image forming member where the photoelectric conductive layer acts as an insulator than in the exposed portion where the photoelectric conductive layer acts as a conductor. The difference in the electric charges corresponds to a difference in electrostatic attractivity of the toner to the surface of the image forming member. Accordingly, a toner image is formed.

A significant shortcoming of the described toner is due to its conductivity which causes the toner charges to be neutralized in a short period of time and residual charges to be lost. Accordingly, the electrostatic attractivity of the toner to plain paper is decreased and it is difficult to completely print an image by known electrostatic printing methods.

Accordingly, it is desirable to provide a toner for use in a printer employing a direct developing process that overcomes the disadvantages of prior art toners.

SUMMARY OF THE INVENTION

Generally speaking, in accordance with the invention, a printer using a combination toner having both a conductive portion and an insulating portion is provided. The toners can be either magnetic or non-magnetic. The conductive and insulating portions can be provided as separate portions of the same toner particle, the conductive portions can be electrically floating on the surface of the insulating portion, both the conductive portion and the insulating portion can be provided on the surface of the toner such that the conductive portion is formed of a P or N type semiconductor or the toner can have anistropic electrical properties. In further alternate embodiments, the toner can have a core consisting of a binding resin, a dyeing agent and a magnetic material with a resin layer having a photoelectric conductive agent dispersed therein covering the core, the toner can be formed by mixing a conductive toner with an insulating toner, the toner can include a wax insulating portion or the toner can have a bonding resin having a thermoplastic elastomer in which fine conductive particles are dispersed as a main constituent.

Accordingly, it is an object of the invention to provide an improved toner in which images are completely printed by a direct developing process and can be easily transferred onto plain paper.

Another object of the invention is to provide an improved toner in which conductive and insulative portions are provided on each toner particle.

A further object of the invention is to provide a toner having a plurality of conductive portions electrically floating on the surface of an insulating material.

Yet another object of the invention is to provide a toner having a plurality of insulating and conductive portions on its surface wherein the conductive portions are P and N type semiconductors.

A further object of the invention is to provide a toner having anisotropic electrical properties.

Another object of the invention is to provide a toner having a core consisting of a binding resin, a dyeing agent and a magnetic material with a resin layer having a photoelectric conductive agent dispersed therein covering the core.

A further object of the invention is to provide a combination toner by mixing a conductive toner with an insulating toner.

Yet a further object of the invention is to provide a toner that includes wax.

Still another object of the invention is to provide a toner that has a binding resin as a main constituent and in which conductive fine particles are disperdsed in the binding resin.

A further object of the invention is to provide a printer that employs combination toners having conductive and insulating portions to perform a direct developing process.

Still other objects and advantages of the invention will in part be obvious and will in part be apparent from the specification.

The invention accordingly comprises the product which possesses the characteristics, properties, and the relation of constituents, the several steps and the relation of one or more of such steps with respect to each of the others, and the apparatus embodying features of construction, combinations and arrangement of parts which are adapted to effect such steps, all as exemplified in the detailed disclosure herein after set forth, and the scope of the invention will be indicated in the claim.

DESCRIPTION OF THE DRAWINGS

For a fuller understanding of the invention, reference is had to the following description taken in connection with the accompanying drawings, in which:

FIG. 2A is a diagram of an alternate embodiment of a printer constructed and arranged in acccordance with the invention;

FIG. 2B is an enlarged view of the image forming member of the printer of FIG. 2A;

FIG. 3A is a plan view of a toner particle constructed and arranged in accordance with the invention;

FIG. 3B is a cross-sectional view of the toner particle of FIG. 3A;

FIG. 4A is a plan view of a toner particle constructed and arranged in accordance with an alternate embodiment of the invention;

FIG. 4B is a cross-sectional view of the toner particle of FIG. 4A;

FIG. 48 is a plan view of a toner constructed and arranged in accordance with a further alternate embodiment of the invention;

FIG. 49 is a diagram showing image formation by a direct developing process using the toner of FIG. 48 in the printer of FIGS. 2A and 2B;

DETAILED DESCRIPTION OF THE PREFERRED EMBODIMENTS

The combination toner provided in accordance with the invention is useful in a printer employing a xerography process to print images. The toner includes at least one conductive portion that functions to accumulate a charge in the toner. The toner also includes at least one insulative portion that functions to lengthen the period of discharge of the accumulated charge.

The toner can have a conductive portion and an insulating portion as part of each toner particle, each toner particle can have a plurality of conductive portions electrically floating on the surface of an insulating material, each toner particle can have a plurality of insulating and conductive portions on the surface with the conductive portion being P or N type semiconductor, or each toner particle can have anistropic electrical properties. In further alternate embodiments, each toner particle has a core consisting primarily of a binding resin, a dyeing agent and a magnetic material with a resin layer having a photoelectric conductive agent dispersed therein covering the core, the toner can be prepared by mixing a conductive toner with an insulating toner or can include a wax. Finally, each toner particle can have a bonding resin with a thermoplastic elastometer as the main constituent and conductive fine particles dispersed in the elastomer.

Figure 1A:
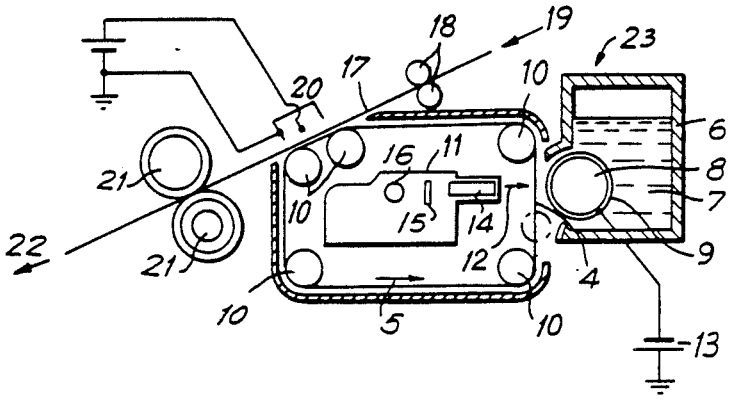
FIG. 1A is a diagram of a printer constructed and arranged in accordance with the invention.
Figure 1B:
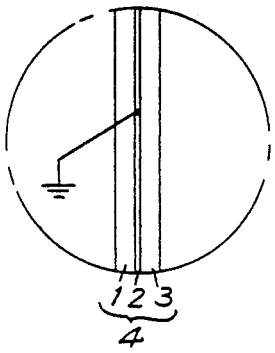
FIG. 1B is an enlarged view of the image forming member of the printer of FIG. 1A.

Reference is now made to FIGS. 1A and 1B wherein a printer 23 including an image forming member 4 consisting of a belt-like transparent supporting base 1, a transparent conductive layer 2 provided on base 1 and a photoconductive layer 3 provided on transparent conductive layer 2 is depicted. Image forming member 4 is rotated in the direction of arrow 5 by rollers 10.

A toner supplier 6 contains a toner 7 that is transferred to the surface of image forming member 4 by a conventional magnetic brush consisting of a magnetic roller 8 and a sleeve 9. Toner 7 supplied in this manner contacts image forming member 4 from the side opposite the side of exposure either during the period of exposure or immediately after exposure by an exposing light 12 that is delivered from an exposer 11.

A bias voltage 13 is applied to transparent conductive layer 2 of image forming member 4 and to sleeve 9 of the magnetic brush. As a result of a bias voltage 13 that has been applied to transparent conductive layer 2 of image forming member 4 and to sleeve 9, the adhesiveness of toner 7 to the surface of image forming member 4 is determined by whether or not image forming member 4 has been exposed. As a result of exposure, toner 7 adheres to image forming member 4 to form a negative image as a result of bias voltage 13. Toner 7 strongly adheres to the surface of image forming member 4 in an area of complete exposure and partially adheres to the surface depending on the degree of exposure.

Exposer 11 is formed primarily of a self-focusing rod lens array 14, a liquid crystal shutter (LCS) head substrate 15 and a linear light source 16. Linear light source 16 can be, for example, a halogen lamp or a fluorescent lamp. An example of the LCS head substrate is disclosed in Japanese Patent Laid Open Application No. 58-193521.

Image forming member 4 on which the negative toner image has been formed moves in the direction of arrow 5 at a predetermined speed. A recording medium 17 such as paper is supplied by a feeding roller 18 from the direction of arrow 19. Recording medium 17 moves beneath a conventional coronatron 20 facing image forming member 4 at the same speed as that of image forming member 4. As used herein, a "coronatron" is an apparatus for producing an electric discharge due to ionization of surrounding air. Accordingly, the toner image is electrostatically transferred from image forming member 4 to recording medium 17.

The toner image copied onto recording medium 17 passes between a pair of conventional thermal fixing rollers 21. Recording medium 17 on which a toner image has been fixedly transferred is then output as printed matter in the direction of arrow 22.

Following image transfer, image forming member 4 returns to the image forming portion consisting of toner supplier 6 and exposer 11 and is ready for the next printing process. Residual toner particles that were not transferred to the recording medium may remain on image forming member 4. Since the electric charge of these particles has been neutralized as a function of the discharge of the toner and image forming member 4, electrostatic attractivity has been decreased. Accordingly, residual toner particles are collected by the magnetic brush of toner supplier 6.

Referring to FIGS. 2A and 2B, wherein another printer 23' that is useful with toners of the invention and wherein like reference numerals primed designate like elements as in FIGS. 1A and 1B, an image forming member 4' consists of a belt-like transparent supporting base 1', a transparent conductive layer 2' formed on base 1' and a photoconductive layer 3' formed on transparent conductive layer 2'. Image forming member 4' is rotated in the direction of arrow 5' by rollers 10'. A toner supplier 6' contains a toner 7' which is transferred to the surface of image forming member 4' by a conventional magnetic brush consisting of a magnetic roller 8' and a sleeve 9'.

A toner layer supplied in this manner contacts image forming member 4' from the side opposite of exposure either during or immediately following exposure by an exposing light 12' delivered from an exposer 11'. As a result of a bias voltage 13' that has been applied to transparent conductive layer 2' of image forming member 4' and to sleeve 9', the adhesiveness of the toner 7' to the surface of image forming member 4' is determined by whether or not image forming member 4' has been exposed. As a result of exposure, the toner adheres to image forming member 4' to form a negative image.

Exposer 11' consists primarily of a self-focusing rod lens array 14', an LCS head substrate 15' and a linear light source 16' which can be a halogen lamp or a fluorescent lamp. An example of an LCS head substrate is disclosed in Japanese Laid Open Application No. 58-193521.

Image forming member 4' on which the toner image has been formed moves at a predetermined speed in the direction of arrow 5'. A recording medium 17' is fed by a feeding roller 18' from the direction of arrow 19'. Recording medium 17' passes beneath a small electric current heat roll 24' at the same speed as that of image forming member 4'. Accordingly, the toner image is transferred from image forming member 4' to recording medium 17'.

The toner image formed on recording medium 17' passes under a conventional thermal fixing roller 21'. Recording medium 17' on which a toner image has been fixedly transferred is then output as printed matter in the direction of arrow 22'.

Following image transfer, image forming member 4' returns to the image forming portion consisting of toner supplier 6' and exposer 11' and is ready for the next printing process. Toner particles having a small amount of wax that have been melted by heat during image copy or that have not been melted may remain on image forming member 4'. However, wax included in the residual toner is cooled and hardened at the end of one cycle of the printing process and electric charges accumulated during development of the image are neutralized during the discharge period. Accordingly, the adhesiveness of the residual toner particles decreases and the particles are collected by the magnetic brush of the toner supplier.

The toner will now be described in more detail with reference to each of the specific embodiments.

Embodiment 1

In the toner of this embodiment, each toner particle has a conductive portion and an insulating portion. When this toner is used in a direct developing process, electric charge is supplied to toner that is in contact with the surface of an image forming member through the conductive portion of the toner particles. The electric charge and accordingly, attractivity of the toner to the recording medium at the time of electrostatic transfer, is maintained by the insulating portion of the toner particles to which electric charge has been supplied.

FIGS. 3A and 3B show the structure of a toner particle 37 prepared in accordance with this embodiment of the invention. Toner particle 37 includes conductive leads 32 having end portions 33. Conductive leads 32 penetrate through an insulating material 31 in which a magnetic material 30 has been dispersed. As can be seen more clearly in the cross-sectional view shown in FIG. 3B, end portions 33 of leads 32 are exposed at the surface of the toner particle.

Magnetic material 30 can be a conventional oxide insulating magnetic powder such as iron ioxide having the formulae $Fe_3O_4$ or $\gamma$-$Fe_2O_3$. Insulating material 31 can be polystyrene or copolymers thereof and can include an appropriate amount of a pigment such as carbon black. In addition, a charge control agent can be used.

The diameter of toner particle 37 is about 10 $\mu$m and the length of conductive leads 32 penetrating through toner 37 is between about 5 and 20 $\mu$m. Conductive leads 32 are non-magnetic and are generally made of pin-like fine particles such as aluminum or stainless steel. These pin-like fine particles are obtained, for example, by evaporating a desired metal in an inert gas.

Another example of a toner of Embodiment 1 is shown in FIGS. 4A and 4B. In FIGS. 4A and 4B, a toner particle 47 includes conductive magnetic leads 42 having end portions 43 penetrating through an insulating material 41. End portions 43 of leads 42 are exposed at the surface of the particle.

Insulating material 41 is generally polystyrene or copolymers thereof and includes an appropriate amount of a pigment such as carbon black as well as a charge control agent. The diameter of toner particle 47 is about 10 $\mu$m and the length of conductive magnetic leads 42 piercing through the particle is between about 5 and 20 $\mu$m. Conductive magnetic leads 42 are generally formed of pin-like fine particles of iron, cobalt and nickel. These pin-like fine particles are obtained, for example, by evaporating a desired metal in an inert gas.

Figure 5:
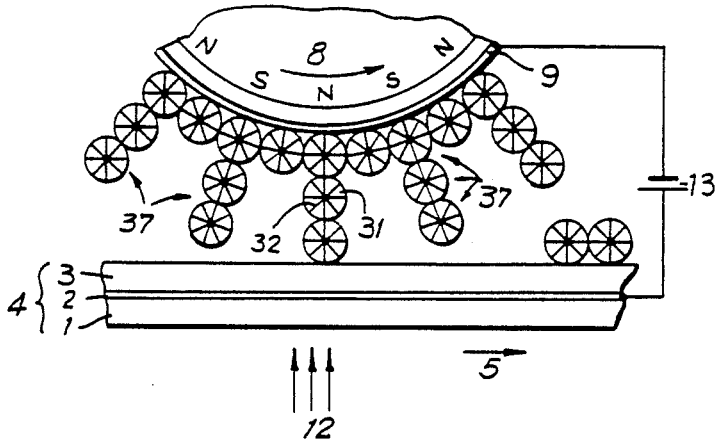
FIG. 5 is a diagram showing image formation by a direct developing process using the toner of FIGS. 3A and 3B in the printer of FIGS. 1A and 1B.

FIG. 5 illustrates image formation by a direct developing process using the toner of FIGS. 3A and 3B in the printer of FIGS. 1A and 1B. Image forming member 4 consists of a transparent supporting base 1, transparent conductive layer 2 laminated on transparent supporting base 1 and photoconductive layer 3 laminated on the transparent conductive layer 2. Image forming member 4 moves in the direction of arrow 5 when image forming member 4 is exposed by image exposing light 12.

A magnetic toner consisting of toner particles 37 is carried by a conventional magnetic brush consisting of magnetic roller 8 and sleeve 9. Insulating material 31 on the surface of toner particles 37 is electrified by sleeve 9 of the brush or by an electrifying blade and the toner contacts photoconductive layer 3 at an exposed portion.

Bias voltage 13 is applied to sleeve 9. As a result, electric charge is conducted to toner particles 37 through conductive leads 32 penetrating through toner particles 37 when toner particles 37 are in contact with photoconductive layer 3. The intensity of the electric charge is different at the exposed and unexposed portions of photoconductive layer 3. As a result, the electrostatic attractivity of toner particles 37 to the surface of photoconductive layer 3 is greater in the area that has been exposed and consequently a negative image is developed. The toner shown in FIGS. 4A and 4B is also suitable for use in the printer of FIGS. 1A and 1B in the manner shown in FIG. 5.

Figure 6:
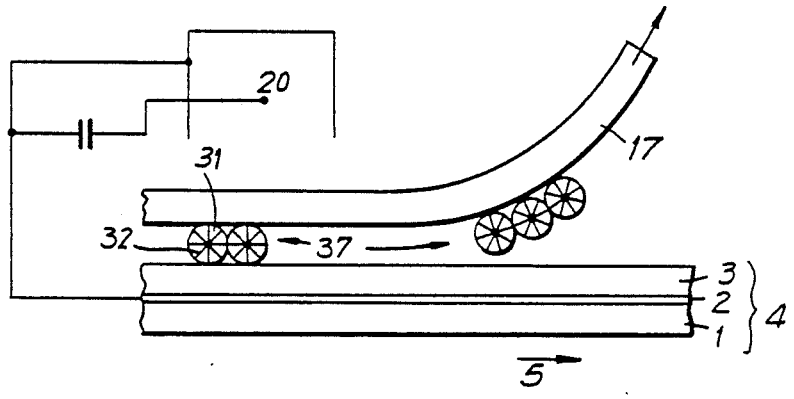
FIG. 6 is a diagram showing image formation onto a recording medium from the image forming member prepared in accordance with FIG. 5.

FIG. 6 illustrates image transfer from image forming member 4 to recording medium 17 by an electrostatic transfer method. Recording medium 17 is placed above the surface of image forming member 4 on which an image has been formed. Ions having a polarity opposite the electric charges on the surface of insulating material 31 of toner particles 37 are introduced to the rear of recording medium 17 by coronatron 20.

The electric charges retained by conductive leads 32 during image formation are instantly neutralized and have no effect on image transfer to recording medium 17. However, since the discharge time for the charges on the surface of insulating material 31 is relatively long, a static force is produced between toner particles 37 and recording medium 17 that results in image transfer. The toner of FIGS. 4A and 4B can also be used for this type of electrostatic transfer.

Figure 7:
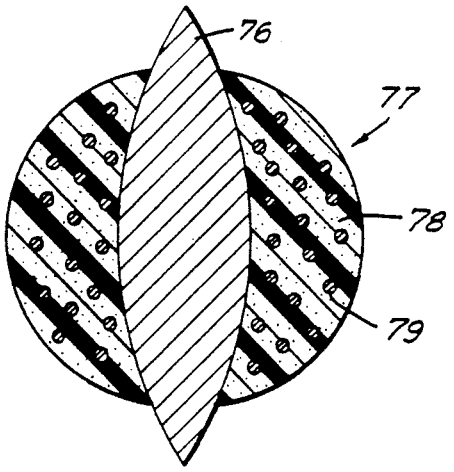
FIG. 7 is a cross-sectional view of another toner particle constructed and arranged in accordance with the invention.

FIG. 7 shows another toner particle 77 prepared in accordance with this embodiment of the invention. Toner particle 77 has an insulating resin 78 in which a pigment 79 and other additives are dispersed around a conductive magnetic pin-like material 76.

Thermoplastic resins can desirably be used for insulative resin 78. Examples include polystyrene and copolymers thereof, polyesters and copolymers thereof, polyethylene and copolmers thereof, acrylic resin, vinyl resin and the like. The resins can be used alone or in combination.

Conductive magnetic pin-like material 76 can be an iron-cobalt alloy, cobalt-nickel alloy and the like and has a particle length between about 10 and 15 μm and a particle diameter of about 5 μm. Pigment 79 can be nigrosine, spirit black and the like. Toner particle 77 is formed of these materials by conventional kneading, pulverization and classification techniques.

This structure will be further illustrated with reference to the following examples. These examples are presented for purposes of illustration only and are not intended to be construed in a limiting sense.

EXAMPLE 1—1

Acrylic resin (ACRYPET, a product of Mitsubishi Kasei) was used as an insulating resin, an iron-cobalt alloy having a particle length between about 10 and 15 μm and a particle diameter of about 5 μm was used as a conductive magnetic pin-like material and nigrosine was used as a dyeing agent in the proportions indicated in Table 1—.

TABLE 1-1

| Sample No. | Insulating Resin (wt %) | Conductive Magnetic Pin-like Material (wt %) | Pigment (wt %) |
|---|---|---|---|
| 1 | 50 | 40 | 10 |
| 2 | 43 | 50 | 7 |
| 3 | 35 | 60 | 5 |
| 4 | 22 | 70 | 3 |

The materials in each sample were mixed together and kneading using a screw extruder. Then the kneaded materials were roughly ground using a stamp mill to a size between about 0.1 and 0.5 mm and the ground materials were further pulverized using a jet mill to a size between about 5 and 20 μm. The materials were classified using a dry screen classifier to a size between about 10 and 15 μm to yield the toner.

Image transfer formation, transfer and fixation were accomplished by a direct developing process (DDP) using these one-compound magnetic toners. Satisfactory fixed images were obtained.

COMPARATIVE EXAMPLE 1—1

Toners having the compositions shown in Table 1-2 were prepared by the method of Example 1—1.

TABLE 1-2

| Sample No. | Insulating Resin (wt %) | Conductive Magnetic Pin-like Material (wt %) | Pigment (wt %) |
|---|---|---|---|
| 5 | 60 | 20 | 20 |
| 6 | 60 | 30 | 10 |
| 7 | 22 | 75 | 3 |
| 8 | 18 | 80 | 2 |

Image transfer formation, transfer and fixation was attempted using the single component magnetic toners of Comparative Examples 5 to 8. For Samples 5 and 6, no image was formed since the amoun of conductive magnetic pin-like material was too small and a sufficient electric charge could not be supplied. For Samples 7 and 8, the image was not transferred since the amount of insulating resin was too small and the charge necessary for image transfer could not be maintained efficiently.

EXAMPLE 1-2

Polystyrene resin (STYLON, a product of Asahi Kasei) was used as an insulating resin, a cobalt-nickel alloy having a particle length between about 10 and 15 μm and a particle diameter of about 5 μm was used as a conductive magnetic pin-like material and spirit black was used as a dyeing agent in the proportions indicated in Table 1-3.

TABLE 1-3

| Sample No. | Insulating Resin (wt %) | Conductive Magnetic Pin-like Material (wt %) | Pigment (wt %) |
|---|---|---|---|
| 9 | 50 | 40 | 10 |
| 10 | 43 | 50 | 7 |
| 11 | 35 | 60 | 5 |

TABLE 1-3-continued

| Sample No. | Insulating Resin (wt %) | Conductive Magnetic Pin-like Material (wt %) | Pigment (wt %) |
|---|---|---|---|
| 12 | 22 | 70 | 3 |

The materials were mixed together and kneaded using a screw extruder. Then the kneaded materials were ground using a stamp mill to a size between about 0.1 and 0.5 mm and the ground materials were further pulverized using a jet mill to a size between about 5 and 20 μm. The materials were classified using a dry screen classifier to a size between about 10 and 15 μm to yield the toner.

Image transfer formation, transfer and fixation were accomplished by a direct developing process using these one-compound magnetic toners. Satisfactory fixed images were obtained.

COMPARATIVE EXAMPLE 1-2

Toners having the compositions shown in Table 1-4 were prepared by the method of Example 1—3.

TABLE 1-4

| Sample No. | Insulating Resin (wt %) | Conductive Magnetic Pin-like Material (wt %) | Pigment (wt %) |
|---|---|---|---|
| 13 | 60 | 20 | 20 |
| 14 | 60 | 30 | 10 |
| 15 | 22 | 75 | 3 |
| 16 | 18 | 80 | 2 |

Image transfer formation, transfer and fixation was attempted using the single component magnetic toners of Comparative Examples 13 to 16. For Samples 13 and 14, no image was formed since the amount of conductive magnetic pin-like material was too small and sufficient electric charge could not be supplied. For Samples 15 and 16, the image was not transferred since the amount of insulating resin was too small and the charge necessary for image transfer could not be maintained efficiently.

Figure 8:
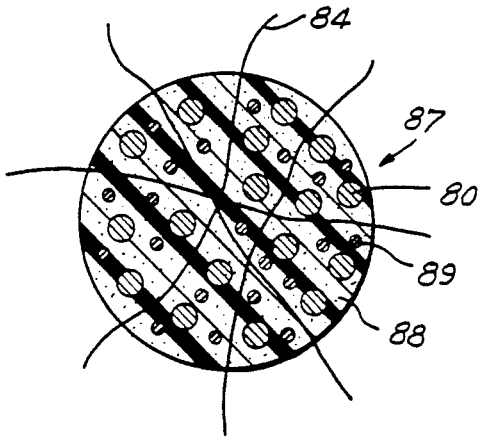
FIG. 8 is a cross-sectional view of a further toner particle constructed and arranged in accordance with an alternate embodiment of the invention.

FIG. 8 is a sectional view showing another toner particle 87. Toner particle 87 has several conductive fibers 84 penetrating a particle of insulating resin 88 in which a pigment 89, a magnetic material 80 and other additives are dispersed. A portion of fiber 84 is exposed at the surface of the toner particle.

Fibers 84 at the surface of the toner particle become tangled with fibers of a recording medium such as paper and this enhances the efficiency of image transfer. Insulating resin 88 can be a thermoplastic resin such as polyethylene and copolymers thereof, epoxy resin, acrylate and methacrylate and copolymers thereof and vinyl resin, polystyrene and copolymers thereof, polyesters and copolymers thereof, and the like. Any of these thermoplastic resins can be used alone or in combination.

Pigment 89 is generally carbon black, spirit black, nigrosine and the like and is preferably used in an amount between about 1 and 3 percent by weight. Magnetic material 80 is generally a conventional magnetic powder such as $Fe_3O_4$, $\gamma$-$Fe_2O_3$, chrome oxide, nickel ferrite and iron alloy powder.

Other additives including, but not limited to, flow promoting agents such as silicon dioxide ($SiO_2$) and titanium dioxide ($TiO_2$) can be used at concentrations between about 0.1 and 0.5 percent by weight. Conductive fiber 84 is generally a cellulosic fiber or nylon fiber having a specific resistance between about 1 and $10^6$ Ω cm. A toner having a particle diameter between about 10 and 15 μm is made by conventional kneading, pulverization and classification techniques.

EXAMPLE 1-3

Polystyrene resin (STYLON, a product of Asahi Kasei) was used in an insulating resin, cellulosic fibers having a lenght of 1 mm and a specific resistance of either 1 or $10^6$ Ω cm were used as the conductive fiber and spirit black was used as a pigment in the proportions indicated in Table 1-5.

TABLE 1-5

| Sample No. | Resin (wt %) | Magnetic Material (wt %) | Pigment (wt %) | Conductive Fiber (wt %) | Conductive Fiber Resistance (Ωcm) |
|---|---|---|---|---|---|
| 17 | 48 | 40 | 2 | 10 | 1 |
| 18 | 42 | 35 | 3 | 20 | 1 |
| 19 | 36 | 32 | 2 | 30 | 1 |
| 20 | 30 | 27 | 3 | 40 | 1 |
| 21 | 36 | 32 | 2 | 30 | $10^6$ |
| 22 | 30 | 27 | 3 | 40 | $10^6$ |

The materials were mixed together and kneaded using a screw extruder. Then the kneaded materials were roughly ground using a stamp mill to a size between about 0.1 and 0.5 mm and the ground materials were further pulverized using a jet mill to a size between about 5 and 20 μm. The materials were classified using a dry screen classifier to a size between about 10 and 15 μm to yield the toner.

Image formation, transfer and fixation were accomplished by a direct developing process using these one-compound magnetic toner. Satisfactory fixed images were obtained.

COMPARATIVE EXAMPLE 1-3

Toners having the compositions shown in Table 1-6 were prepared by the method of Example 1-3.

TABLE 1-6

| Sample No. | Resin (wt %) | Magnetic Material (wt %) | Pigment (wt %) | Conductive Fiber (wt %) | Conductive Fiber Resistance (Ωcm) |
|---|---|---|---|---|---|
| 23 | 50 | 42 | 3 | 5 | 1 |
| 24 | 28 | 20 | 2 | 50 | 1 |
| 25 | 30 | 27 | 3 | 40 | $10^7$ |
| 26 | 30 | 27 | 3 | 40 | $10^8$ |
| 27 | 30 | 27 | 3 | 40 | $10^9$ |

Image transfer formation and fixation was attempted using the single component magnetic toners of Samples 23-27. For Sample 23, no image was formed since the amount of conductive fibers was too small and sufficient electric charge could not be supplied. For Sample 24, the image was not transferred since the amount of insulating resin was too small and the charge necessary for image transfer could not be maintained efficiently. For Samples 25-27, no image was formed since the resistance of the fibers was too high and a sufficient electric charge could not be supplied.

EXAMPLE 1-4

Polyester (BYLON 200, a product of Toyo Boseki) was used as an insulating resin, nylon fibers having a length of 1 mm and a specific resistance of either 1 or $10^6$Ω cm was used as a conductive fiber and nigrosine was used as a pigment in the proportions indicated in Table 1-7.

TABLE 1-7

| Sample No. | Resin (wt %) | Magnetic Material (wt %) | Pigment (wt %) | Conductive Fiber (wt %) | Conductive Fiber Resistance (Ωcm) |
|---|---|---|---|---|---|
| 28 | 48 | 40 | 2 | 10 | 1 |
| 29 | 42 | 35 | 3 | 20 | 1 |
| 30 | 36 | 32 | 2 | 30 | 1 |
| 31 | 30 | 27 | 3 | 40 | 1 |
| 32 | 36 | 32 | 2 | 30 | $10^6$ |
| 33 | 30 | 27 | 3 | 40 | $10^6$ |

Toners having particle diameters between about 10 and 15 μm were prepared by the method of Example 1-3.

Image formation, transfer and fixation were accomplished by a direct developing process using these one-compound magnetic toners. Satisfactory fixed images were obtained.

COMPARATIVE EXAMPLE 1-4

Toners having the composition shown in Table 1-8 were prepared by the method of Example 1-4.

TABLE 1-8

| Sample No. | Resin (wt %) | Magnetic Material (wt %) | Pigment (wt %) | Conductive Fiber (wt %) | Conductive Fiber Resistance (Ωcm) |
|---|---|---|---|---|---|
| 34 | 50 | 42 | 3 | 5 | 1 |
| 35 | 28 | 20 | 2 | 50 | 1 |
| 36 | 30 | 27 | 3 | 40 | $10^7$ |
| 37 | 30 | 27 | 3 | 40 | $10^8$ |
| 38 | 30 | 27 | 3 | 40 | $10^9$ |

Image formation, transfer and fixation were attempted using the single component magnetic toners of Samples 34–38. For Sample 34, the image was not transferred since the amount of conductive fibers was too small and sufficient electric charge could not be supplied. For Sample 35, no image was formed since the amount of insulating resin was too small and the charge necessary for image transfer could not be maintained efficiently. For Samples 36–38, no image was formed since the conductive fiber resistance was too high and sufficient electric charge could not be supplied.

Figure 9A:
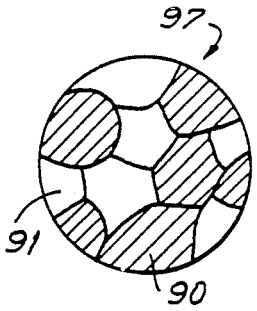
FIG. 9A is a plan view of a spherical toner particle constructed and arranged in accordance with a further alternate embodiment of the invention.
Figure 9B:
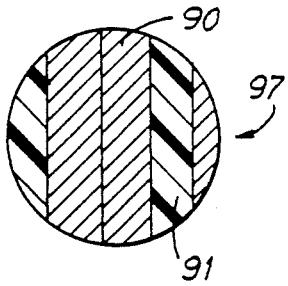
FIG. 9B is a cross-sectional view of a flat toner particle.

Another example of a toner particle 97 prepared in accordance with this embodiment of the invention is shown in FIGS. 9A and 9B. As shown in FIGS. 9A and 9B, toner 97 includes conductive portions 90 randomly arranged with insulating portions 91.

Toner 97 has a structure wherein a first resin portion A has conductivity and a second resin portion B has insulating properties. Resin portions A and B are separately formed into a cylindrical shape and are alternately bonded together. The flux is stretched into a thread-like shape and pulverized to the desired particle diameter.

Binding resins that can be used either as the conductive resin or the insulating resin include styrene resin or polymers thereof, polyester, polyethylene, polypropylene, acryl resin, polyvinyl acetate, polyurethane, polyamide, epoxy resin, polyvinyl chloride, polyvinyl butyral, rosin, modified rosin, terpene resin, phenol resin, aliphatic or aliphatic hydrocarbon resin, aromatic series petroleum resin, chlorinated paraffin and the like. Any of these resins can be dispersed and used alone or in combination.

Conventional magnetic powders such as magnetite, hematite and ferrite or an alloy or compound of iron, cobalt, nickel, manganese and the like can be used as either or both of the conductive or insulating resin. These magnetic powders can be used either alone or in combination.

Carbon black, graphite and the like can be used as a dyeing agent for the conductive resin and as well as the conductive material. A nigrosine series pigment is generally used as a dyeing agent for the insulating resin. Colloidal silica, hydrophobic silica, silicon varnish, metal soap, anionic surfactant, polyvinylidenefluoride fine particles and the like can be used as flow promoting agents.

EXAMPLE 1-5

A mixture of 100 weight percent of polyester (ERPET, a product of Teijin), 50 weight percent of magnetite (EPT-1000, a product of Toda Kogyo) and 10 weight percent of carbon black (CONDUCTEX 975 BEADS, a product of Colombia Carbon Co.) was kneaded using a screw extruder. Resin bars A (100) having a diameter of 5 mm, a length of 30 cm and a specific resistance of $2.0\times10^4\Omega$ cm were formed.

Then a mixture of 100 weight percent polyester, 20 weight percent magnetite and 10 weight percent of black pigment (BONTRON N-09, a product of Orient Kagaku) was kneaded using a screw extruder. Resin bars B (101) having a diameter of 5 mm, a length of 30 cm and a specific resistance of $8\times10^{12}\Omega$ cm were formed. The resistance of resin bar B was $4\times10^8$ times larger than that of resin bar A.

Figure 10:
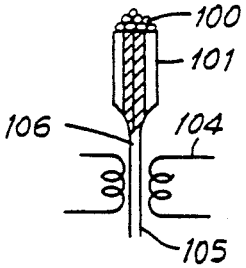
FIG. 10 is a diagram of an apparatus used to prepare the toner of FIGS. 9A and 9B.

FIG. 10 depicts an apparatus used to manufacture toner 97 having the structure shown in FIGS. 9A and 9B. Conductive resin bars 100 and insulating resin bars 101 are bonded together alternately. A flux 106 is passed through a heater 104 to stretch flux 106 to a diameter of 60 μm. A thread 105 of toner composite is cut into lengths of 0.5 mm and pulverized using a jet mill. An air-flow classifier is used to obtain particles having a diameter between about 5 and 20 μm. The average particle diameter of toner 97 shown in FIGS. 9A and 9B is about 10 μm and the diameter of the conductive and insulating portions was about 3 μm.

Printing was accomplished using the direct developing process and clear images were obtained.

EXAMPLE 1-6

A mixture of 100 weight percent of styrene-acryl copolymer, 60 weight percent of magnetite, 10 weight percent of phthalocyanine blue and 0.5 weight percent of a fourth class aluminum salt surfactant were kneaded using a screw extruder and conductive resin bars A having a diameter of about 5 mm and a length of about 30 cm were formed.

Then a mixture of 100 wt % of styrene-acrylic acid butyl copolymer, 60 wt % of magnetite and 5 wt % of sulphonamide derivative dye were kneaded using a screw extruder and insulating resin bars B having a diameter of about 5 mm and a length of about 30 cm were formed.

Using the processes of Example 1-5, toner having an average particle diameter of about 10 μm and blue conductive and insulating portions was obtained. Printing was accomplished using this toner in a direct developing process as described in Example 1-5. Clear images were obtained.

EXAMPLE 1-7

A mixture of 100 wt % of styrene-butadiene copolymer, 60 wt % of ferrite and 10 wt % of carbon black was kneaded and conductive resin bars A having a diameter of 3 mm and a length of 30 cm were obtained. Then a mixture of 100 wt % of styrene-butadiene copolymer, 60 wt % of ferrite and 2 wt % of hydrophobic colloidal silica was kneaded and insulating resin bars B having a diameter of about 3 mm and a length of about 30 cm were obtained. A toner having an average particle diameter of 10 μm was formed using resin bars A and B in the same manner as described in Example 1-5. Printing was accomplished using this toner in a direct developing process and clear images were obtained.

Figure 11A:
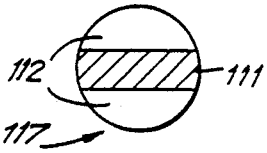
FIG. 11A is a plan view of still another toner particle constructed and arranged in accordance with the invention.
Figure 11B:
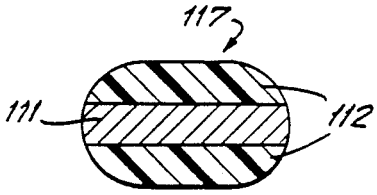
FIG. 11B is a cross-sectional view of the toner particle of FIG. 11A.
Figure 12:
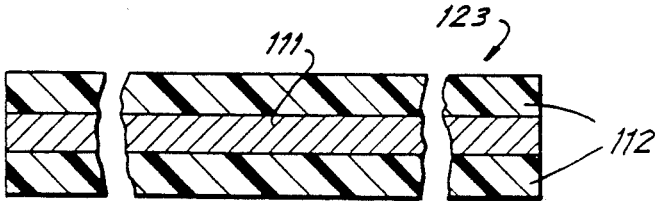
FIG. 12 is a cross-sectional view of a sheet used to prepare the toner of FIGS. 11A and 11B.
Figure 13:
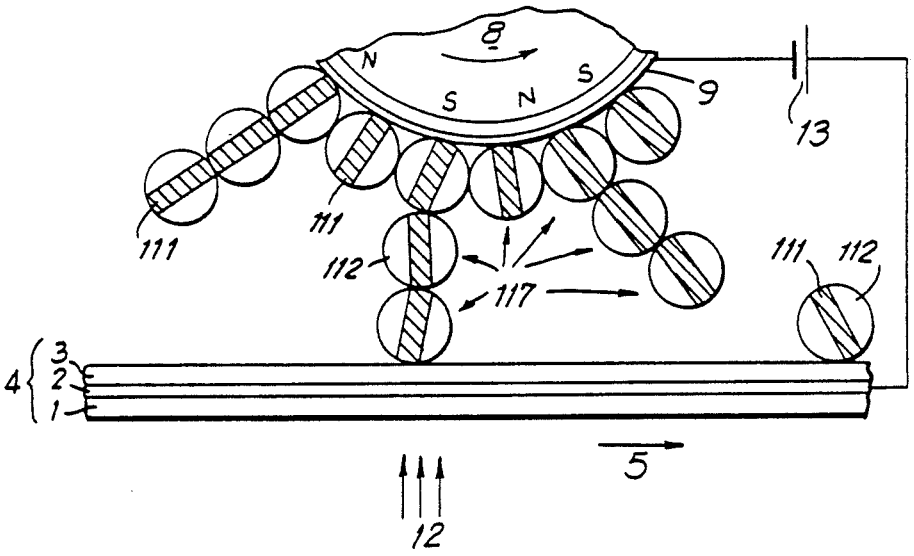
FIG. 13 is a schematic showing image formation by a direct developing process using the toner of FIGS. 11A and 11B in the printer of FIGS. 1A and 1B.

FIG. 13 shows image formation by a direct developing process using toner particles 117 of FIGS. 11A and 11B. Toner 117 includes layers of an insulating portion 112 surrounding a layer of a conductive portion 111 and is formed from a sheet 123 of composite toner as shown in FIG. 12 in the printer of FIGS. 1A and 1B. Image forming member 4 includes transparent supporting base 1, transparent conductive layer 2 laminated thereon and a photoconductive layer 3 laminated on transparent conductive layer 2. Image forming member 4 moves in the direction of arrow 5 when image forming member 4 is subject to image exposing light 12.

Toner 117 is magnetic and is picked up by magnetic brush 9 of magnetic roller 8. Insulating portion 112 of toner 117 is electrified by sleeve 9 or by an electrifying blade and toner 117 contacts photoconductive layer 3 at an exposed portion. Since bias voltage 13 is applied to sleeve 9, an electric charge accumulates in the portion of toner 117 that is in contact with photoconductive layer 3. However, the accumulated charge is different at the exposed portions and the unexposed portions of photoconductive layer 3. As a result, the electrostatic attractivity of toner 117 to the surface of photoconductive layer 3 also differs with the electrostatic attractivity being greater in the area of exposure for developing an image.

Figure 14:
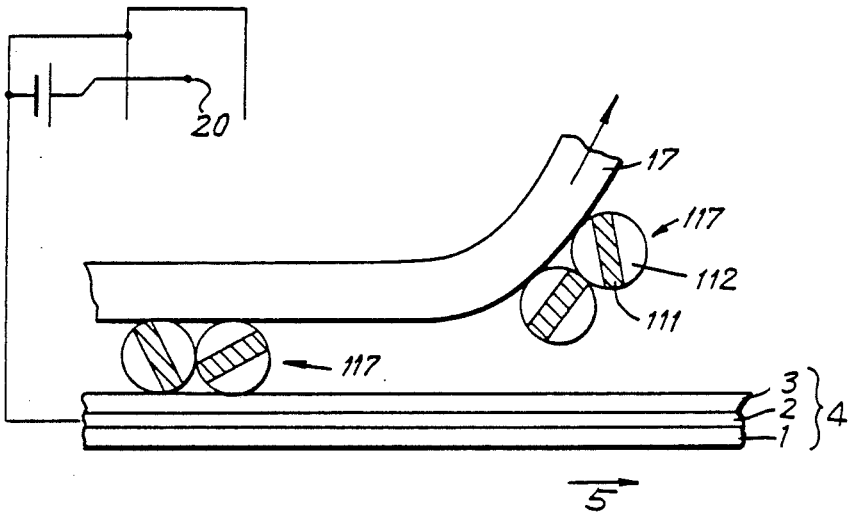
FIG. 14 is a diagram showing electrostatic transfer to a recording medium of an image formed in accordance with FIG. 13.

FIG. 14 depicts image transfer from image forming member 4 to recording medium 17 by electrostatic transfer. Recording medium 17 is placed above the surface of image forming member 4 on which an image has been formed in the manner depicted in FIG. 13. Ions having a polarity opposite to that of the charges at the surface of insulating portion 112 of toner 117 are introduced to the rear of recording medium 17 by coronatron 20. At this time, the accumulated charges in conductive portions 111 are neutralized by the ions and do not transfer an image to recording medium 17. In contrast, since the charges at the surface of insulating portion 112 have a long discharge time, an electrostatic force is produced between toner 117 and recording medium 17 to transfer the image.

Toner 117 is basically a spherical fine particle having a sandwich structure including first insulating layer 112, conductive layer 111 and second insulating layer 112. The process of FIGS. 13 and 14 is equally applicable to an elongated toner particle 117 as shown in FIG. 11B. In order to form first insulating layer 112 on one surface of conductive film 111, a first component is coated and dried. Then in order to form second insulating layer 112 on the other side of conductive film 111, the second component is coated and dried. The first and second component can be the same or different. The complex sheet 123 shown in FIG. 12 that is obtained is then pulverized to yield toner particles 117.

The conductive film is a conductive fine powder and a resin in which the fine powder is dispersed. The conductive fine powder can be, for example, an organic material having high conductivity such as carbon black, metal powder of aluminum, silver, iron, copper, nickel and the like, and fine powders of conductive oxides such as NESA, ITO and the like, or fine particles of calcogenide compounds such as cobalt sulfide, nickel sulfide and the like or organic agent salts of proton conductors.

The resin in which the conductive fine particles are to be dispersed may be a thermoplastic resin such as styrene resin, acrylic resin, polyamide resin, polyester resin, alein acid resin, polyurethane resin, vinyl acetal resin, acrylic acid ester resin, polyethylene resin, ABS resin, polycarbonate resin, nylon resin and the like as well as thermosetting resins such as phenol resin, urea resin, melamine resin, petroleum resin, alkyd resin, epoxy resin and the like. Each of these resins can be used alone or in combination or can be copolymerized or copolycondensed. It is also desirable at times to add a suitable dispersant.

The first and second components are independently selected from inorganic materials such as magnetic powders such as γ-ferrite, iron powder, nickel powder, barium ferrite, manganese and zinc ferrite and inorganic pigments such as zinc oxide, titanium oxide and blood red. Antistatic agents such as silicon dioxide can also be used. Suitable organic materials include dyes, such as nigrosine dye, carmain dye, many types of basic dyes, benzidine yellow pigment, kiphcridon red pigment, rhodamine pigment, phthalocyanine pigment and pilyrene pigment as well as thermoplastic resins such as styrene resin, acrylic resin, polyamide resin, polyester resin, alein acid resin, polyurethane resin, vinyl acetal resin, acrylic acid ester resin, polyethylene resin, ABS resin, polycarbonate resin and silicon resin. Two or more of these materials are mixed to prepare the first component. The second component can be the same or different than the first component.

As described, complex sheet having a conductive layer and an insulating layer is formed by coating a conductive film with a first component on one side and a second component on the other side and drying the film. When the sheet has three layers, the thickness is between about 1 and 100 μm. In order to obtain toners having excellent printing performance, sheets having a thickness between about 5 and 25 μm are preferable. The thicknesses of each of the conductive layer, the first insulating layer and the second insulating layer can be any values so long as the layers exist and the sum of the three thicknesses is between about 5 and 25 μm.

A ball mill, tube mill, conical mill, vibration ball mill, high swing ball mill and hammer mill can be used to grind the complex sheet. The ground sheet is further pulverized using a jet mill, a jet mizer, majack mill, micron mill and the like.

EXAMPLE 1-8

A conductive film having a thickness of about 5 μm was formed of 90 wt % of polycarbonate (PANLITE, a product of Teijin Kasei Kabushiki Kaisha) and 10 wt % of leaf-powder aluminum.

40 wt % acrylic resin (ACRYPET, a product of Mitsubishi Kasei), 50 wt % of $Fe_3O_4$ (EPP 2000, a product of Toda Kogyo) and 10 wt % of nigrosine (a product of Orient Kagaku) were dissolved and dispersed in acetone to form the first component. One side of the conductive film was coated with the first component using a bar coater and dried to form insulating layer III having a thickness of about 5 μm.

The other side of the conductive film was coated with a second component which was the same as the first component. The second component was dried to form the second insulating layer III having a thickness of about 5 μm.

The resulting combination sheet was ground using a ball mill to form particles having a diameter between about 0.1 and 0.5 mm. These particles were further pulverized using a jet mill. The samples obtained were classified to yield a toner having an average particle diameter of 10 μm, which is referred to as Toner 1–8.

EXAMPLE 1–9

A conductive film having a thickness of about 5 μm was formed of 75 wt % of ABS resin (a product of Nippon Gosei Gomu) and 25 wt % of acetylene black.

45 wt % of polystyrene (STALOYN, a product of Asahi Kasei Kogyo Kabushiki Kaisha), 25 wt % of $Fe_3O_4$ (EEP 2000, a product of Toda Kogyo), 10 wt % of silicon dioxide ($SiO_2$) (a product of Nihon Aerosil) and 20 wt % of nigrosine (a product of Orient Kagaku) were dissolved and dispersed in acetone to form the first and second components. A toner was prepared using the method of Example 1–8 and is referred to as Toner 1–9.

Image formation was accomplished by a direct developing process using Toners 1–8 and 1–9 and satisfactory images were copied onto plain paper. The success of image formation and transfer using Toners 1–8 and 1–9 was due to the fact that the electrically conductive phase and the insulating phase exist in the same fine toner particles. Accordingly, the steps of carrying the toner by the magnetic brush, accumulating electric charges in the conductive portion in the toner particles and transferring an image by electrostatic transfer at the surface of the insulating portion of the toner particles were performed successfully.

Figure 15:
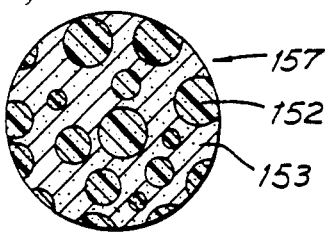
FIG. 15 is a cross-sectional view of a toner particle constructed and arranged in accordance with a further alternate embodiment of the invention.

FIG. 15 is a cross-sectional view of another example of a toner 157 used in the printer of the invention. Toner 157 has a structure wherein insulating resin portion 152 is dispersed without mixing in the inside of conductive portions 153.

Insulating resin portion 152 is composed primarily of conventional thermoplastic resins, such as polystyrene, polyethylene and acryl and conventional oxide insulating magnetic powder such as $Fe_3O_4$ and $\gamma$-$Fe_2O_3$. Additionally, the insulating resin can include a pigment such as nigrosine, a suitable flow promoting agent and a charge.

Conductive resin portion 153 is primarily a thermoplastic resin having a thermo-melting point of at least 5° C. higher than that of the thermoplastic resin used for insulating resin portion 152. A conventional conductive magnetic powder, such as iron, cobalt and nickel is used in addition to the resin. A conductive pigment, such as carbon black, a suitable flow promoting agent and a charge control agent can also be used.

The two types of resins are formed separately using the materials described. The resins are kneaded using a conventional kneader such as a screw extruder at a temperature between the melting point of the thermoplastic resin used for conductive portion 153 and the melting point of the thermoplastic resin used for insulating resin portion 152. The kneaded materials are ground using a conventional device such as a hammer crasher and then pulverized using a conventional device such as a jet mill. When necessary, the sample obtained is classified using a dry-type screen classifier. The resulting toner particles has a particle diameter between about 5 and 15 μm and in which insulating resin portion 152 and conductive resin portion 153 are not mixed with each is obtained.

Figure 16:
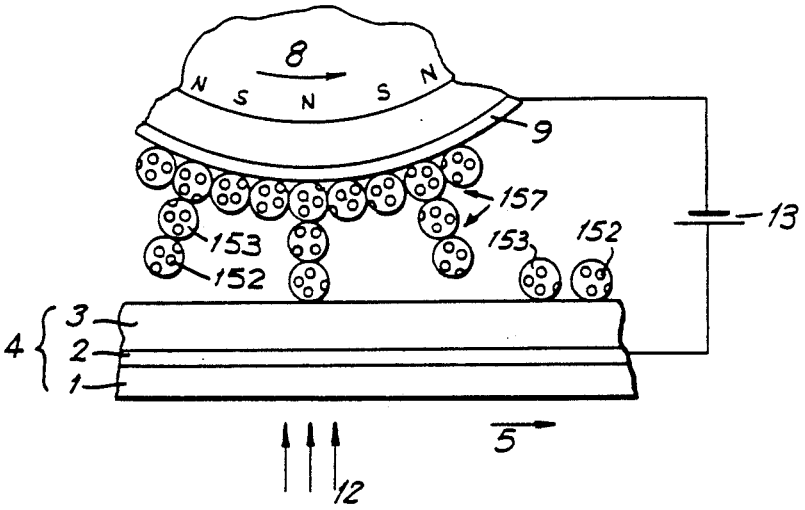
FIG. 16 is a diagram showing image formation by a direct developing process using the toner of FIG. 15 in the printer of FIGS. 1A and 1B.

FIG. 16 is an illustration of how image formation is accomplished by a direct developing process using a toner particle 157 in the printer of FIGS. 1A and 1B. Image forming member 4 includes transparent supporting base 1, transparent conductive layer 2 formed thereon and photoconductive layer 3 formed on transparent conductive layer 2. Image forming member 4 moves in the direction of arrow 5 when image forming member 4 is subjected to image exposing light 12.

Toner 157 having magnetic properties is picked up by a magnetic brush sleeve 9 of magnetic roller 8. An inner insulating resin portion 152 of toner 157 is electrified by sleeve 9 or by an electrifying blade and toner particles 157 contact photoconductive layer 3. Since bias voltage 13 is applied to sleeve 9, electric charges accumulate in toner 157 through conductive resin portions 153. However, the amount of accumulated charge differs in the exposed and unexposed portions. Accordingly, the electrostatic attractivity of toner 157 to the surface of photoconductive layer 3 differs between these portions and an image is formed.

Figure 17:
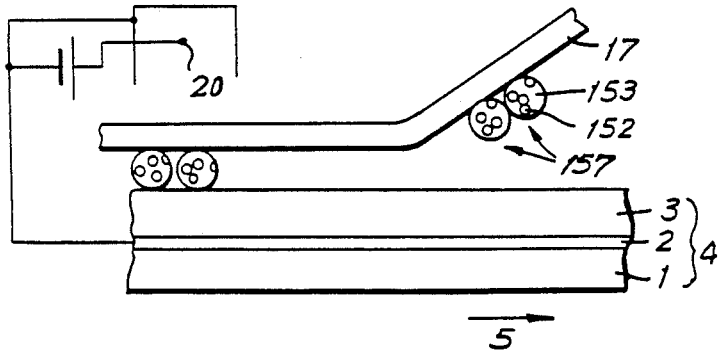
FIG. 17 is a diagram showing electrostatic transfer to a recording medium of the toner image formed as shown in FIG. 16.

FIG. 17 shows how the image is transferred from image forming member 4 to recording medium 17 using toner 157. Recording medium 17 is placed on the surface of image forming member 4 on which an image has been developed and which is moving in the direction of arrow 5. Ions having a polarity opposite that of the electric charges of the surface of insulating resin portion 152 of toner 157 are deposited on the rear of recording medium 17 by coronatron 20.

The electric charges in the conductive resin portions 153 of the toner that have been created during image formation are instantly neutralized and do not affect image transfer to recording medium 17. In contrast, since the electric charges at the surface of insulating resin portion 152 have a longer discharge time, the charges produce an electrostatic force between toner 157 and recording medium 17 and the image is copied.

Another toner structure of this embodiment is prepared by including a foaming agent having a decomposition temperature higher than the melting point of a binding resin at a concentration between about 0.2 and 10 wt % in a conductive resin. The conductive resin is heated to form a foam and the insulating material is filled with the foam. Accordingly, a magnetic toner in which each particle includes conductive and insulating portions is prepared. The magnetic toner has substantially spherical foams having a diameter of several microns and the insulating portions are provided at the surface.

When using this type of toner in a direct developing process, electric charges are accumulated in the toner particles at the tip of the magnetic brush through the conductive portions when the image is formed. When the image is electrostatically transferred, attractivity of the toner to the recording medium is maintained by the electric charges previously accumulated in the insulating portion of the toner. Accordingly, image transfer efficiency is greatly enhanced.

EXAMPLE 1-10

45 wt % of acryl was used as a binding resin, 45 wt % of iron oxide ($Fe_3O_4$) was used as a magnetic powder, 8 wt % of carbon black was used as a dye and 2 wt % of diazoaminobenzene having a decomposition temperature of about 180° C. was used as a foaming agent. The components were mixed and the mixture was heated, melted and kneaded using a screw extruder. The cylinder portion of the screw extruder was then heated to 210° C. and the acryl binding resin having a curing point of 68° C. was melted. Additionally, the diazoaminobenzene was decomposed to produce nitrogen gas. A uniform mixture having foam and a specific resistance of $2\times10^4\Omega$ cm was formed in the screw extruder.

A section of the resulting sample was observed using an electronic microscope and foams having a size between 0.5 and 7 μm and an average diameter of 2.5 μm were observed. The opening rate of the foams was 32%.

The sample was ground using a stamp mill, further pulverized using a jet mill and thereafter classified using a dry air-flow classifier to obtain conductive magnetic particles having a size between about 5 and 20 μm.

The foams at the surface portion of the conductive magnetic particles were filled with a polystyrene resin having a specific resistance of $10^{16}\Omega$ cm which had been pulverized using a ball mill to a size less than or equal to 0.5 μm. The mixing ratio of conductive magnetic particles to polystyrene was 1 part conductive magnetic particles to 0.2 parts polystyrene by weight.

The conductive particles and the polystyrene were fused using a dry heat treating apparatus and spherical toner particles were formed.

The physical properties of the toner were:

| | |
|---|---|
| Specific resistance | $5\times10^6$ Ωcm |
| Angle of repose | 42° |
| Saturation magnetization | 45 emu/g |
| Average particle diameter | 11.5 μm |

Using a direct developing process, an image transfer efficiency rate of 79% was achieved under conditions of 40% relative humidity at a room temperature of 22° C.

EXAMPLE 1-11

45 wt % of iron oxide ($Fe_3O_4$) was used as a magnetic powder, 8 wt % of carbon black was used as a dye, acryl was used as a binding resin and diazoaminobenzene was used as a foaming agent in the amounts shown in Table 1-9. The toners were obtained by mixing the components according to the processes of Example 1-10.

Table 1-9 also shows the mean particle diameter and the opening rate of the foams, the specific resistance of the toner, the image transfer efficiency of a direct developing process at conditions of 40% relative humidity and 22° C. and a relative evaluation of the toner.

TABLE 1-9

| Composition (wt %) | | Foams | | Toner | | |
|---|---|---|---|---|---|---|
| | diazoamino- | mean diameter | opening | resistance | efficiency | DDP |
| acryl | benzene | (micron) | rate (%) | (Ωcm) | (%) | evaluation |
| 46.9 | 0.1 | 2.1 | 4 | $3\times10^4$ | 47 | Δ |
| 46.8 | 0.2 | 2.2 | 6 | $10^5$ | 50 | |
| 46 | 1 | 2.5 | 14 | $10^6$ | 70 | |
| 42 | 5 | 2.4 | 52 | $2\times10^8$ | 69 | |
| 37 | 10 | 3.5 | 80 | $10^{10}$ | 51 | |
| 36 | 11 | 4.0 | 85 | $3\times10^{10}$ | 45 | Δ |

" " indicates satisfactory performance; "Δ" indicates unsatisfactory performance.

EXAMPLE 1-12

45 wt % of acryl was used as a binding resin, 45 wt % of $Fe_3O_4$ was used as a magnetic powder, 8 wt % of carbon black was used as a dye and 2 wt % of N,N'-dinitroxopentamethylenetetramine or benzonsulphonylhydrazide was used as a foaming agent. The components were mixed using the method of Example 1-10 to form a toner. Table 1-10 shows the decomposition temperature of the foaming agent, the average particle diameter and opening of the foams, the specific resistance of the toner and the rate of image transfer efficiency using a direct developing process at conditions of 40% relative humidity and a room temperature of 22° C.

TABLE 1-10

| | Foams | | | Toner | |
|---|---|---|---|---|---|
| Foaming Agent | Decomposition Temp. (°C.) | Mean Particle Diameter (Micron) | Opening Rate (%) | Specific Resistance (Ωcm) | DDP Efficiency (%) |
| N.N'dinitroso-pentamethylene tetramine | 145 | 3.0 | 36 | $10^7$ | 68 |
| Benzonsulphonyl hydrazide | 97 | 3.2 | 45 | $7\times10^7$ | 66 |

Figure 18:
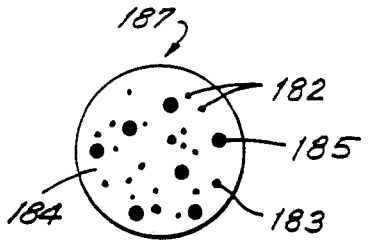
FIG. 18 is a plan view of a toner particle constructed and arranged in accordancce with another embodiment of the invention.

Another toner structure 187 that is useful in this embodiment of the invention is shown in FIG. 18. Toner particle 187 includes a conductive portion 184 in which a magnetic material 182 and a dyeing agent 183 are dispersed. An electrical insulating portion 185 is scattered on the surface of conductive portion 184.

Toner particle 187 is prepared by forming insulating layer 185 having a thickness of less than about 2 μm on conductive material 184. Conductive portion 184 consists primarily of a binding resin, dyeing agent 183 and magnetic material 182. The coating ratio of insulating portion 185 to conductive portion 184 is between about 10 and 90%.

The binding resin can include styrene resin or polymers thereof, polyester, polyethylene, polypropylene, acryl resin, polyvinyl acetate, polyurethane, polyamide, epoxy resin, polyvinyl chloride, polyvinyl butyral, rosin, modified rosin, terpene resin, phenol resin, aliphatic resins, aliphatic hydrocarbon resins, aromatic petroleum resins, chloric paraphine and the like. These resins can be used alone or in combination.

Conventional materials such as carbon black, nigrosine, metal complex salts and the like can be used for dyeing, co-dyeing, electrification control and the like. Magnetic powders can be selected from alloys or compounds of iron, cobalt, nickel, manganese and the like such as magnetite, hematite and ferrite as well as other magnetic materials.

The insulating material is preferably hydrophobic colloidal silica or fine particles of silica. After completely coating the surface of the toner with an insulating material using hot air flow or a ball mill, the surface coating is partially removed using ultrasonic vibration or high speed air flow.

Figure 19:
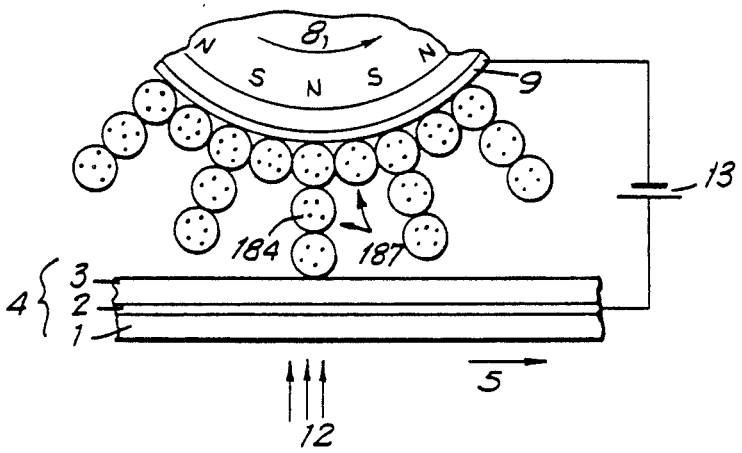
FIG. 19 is a diagram showing image formation by a direct developing process using the toner of FIG. 18 in the printer of FIGS. 1A and 1B.

FIG. 19 illustrates image formation by a direct developing process using toner particle 187 of FIG. 18 in printer 23 of FIGS. 1A and 1B. Toner 187 includes a magnetic portion 182 and an insulating portion 185. Image forming member 4 includes a transparent supporting base 1, transparent conductive layer 2 thereon and photoconductive layer 3 on transparent conductive layer 2. Image forming member 4 moves in the direction of arrow 5 when member 4 is subject to image exposing light 12.

Magnetic toner 187 is picked up by magnetic roller 8 from a magnetic brush on the surface of sleeve 9. An inner insulating resin portion 185 of toner 187 is electrified by sleeve 9 or by an electrifying blade and toner particles 187 contact photoconductive layer 3. Since bias voltage 13 is applied to sleeve 9, electric charges accumulate in toner 187 through conductive resin portions. However, the amount of accumulated charges differs in the exposed and unexposed portions.

The charge accumulated in the toner depends on whether the toner is in contact with an exposed or unexposed portion of photoconductive layer 3 and the electrostatic attractivity of toner particles 187 to photoconductive layer 3 is greater in exposed portions of photoconductive layer 3 in order to develop an image.

Figure 20:
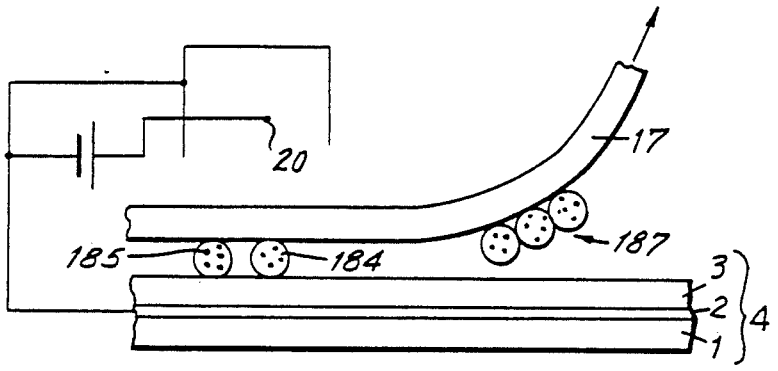
FIG. 20 is a diagram showing electrostatic transfer to a recording medium of the toner of FIG. 18 from the image forming member prepared in accordance with FIG. 19.

Toner particles 187 are transferred from image forming member 4 to recording medium 17 as shown in FIG. 20. Recording medium 17 is placed on the surface of image forming member 4 on which an image has been formed. Ions having a polarity opposite to that of the electric charges at the surface of insulating portion 185 of toner particles 187 are deposited on recording medium 17 from the rear by coronatron 20.

The electric charges present in conductive portion 184 of toner particles 187 that resulted during image formation are neutralized and accordingly, the image is not transferred to recording medium 17 at these portions. Since the electric charges at the surface of insulating portion 185 of toner particles 187 have a longer discharge time, the charges produce an electrostatic force between toner particles 187 and recording medium 17 for transferring the image.

EXAMPLE 1-13

100 parts of styrene-acryl polymer, 90 parts of magnetite used as a magnetic material and 10 parts of carbon black were kneaded using a roll mill. The kneaded mixture was ground using a stamp mill and further pulverized using a jet mill. Particles having a mean particle diameter of 10 μm were obtained using an air flow classifier.

Hydrophobic colloidal silica having a mean particle diameter of 16 mμ (AEROSIL R-972) was mixed with the conductive particles in the ratios shown in Table 1-11. The surface of the toner was coated with silica in hot air to a thickness of between about 16 and 25 mμ.

The toner surface was observed using microscopic photography and the coating ratio was calculated from the area ratio on the photographs. Then, image copying experiments on ten thousand (10,000) sheets of A-4 plain paper were conducted. The results are shown in Table 1-11.

TABLE 1-11

| Sample No. | Toner | Silica | Coating Ratio | DDP | Efficiency |
|---|---|---|---|---|---|
| 39 | 1000 g | 7.8 g | 98% | impossible | —% |
| 40 | 1000 g | 7.0 g | 89% | possible | 81% |
| 41 | 1000 g | 3.9 g | 50% | possible | 82% |
| 42 | 1000 g | 0.7 g | 9% | possible | 72% |
| 43 | 1000 g | 0.2 g | 3% | possible | 62% |

As can be seen from Table 1-11, when the coating ratio was near 100%, no images were transferred using a direct developing process. When the coating ratio was less than about 10%, image transfer efficiency was low.

EXAMPLE 1-14

A mixture of 40 parts of polyester resin, 40 parts of polystyrene resin, 80 parts of magnetite used as a magnetic material and 10 parts of carbon black was kneaded using a conventional screw extruder. The kneaded mixture was ground using a stamp mill and further pulverized using a jet mill. Toner particles having an average mean diameter of 10 μm were obtained by classification using an air flow classifier.

Hydrophobic colloidal silica (AEROSIL R-972) was mixed with the conductive toner particles at the mixing ratios shown in Table 1-12 and the surface of the toner was coated with silica to a thickness of between about 16 and 30 mμ in hot air.

TABLE 1-12

| Sample No. | Toner | Silica | Mixing Ratio | DDP | Efficiency |
|---|---|---|---|---|---|
| 44 | 1000 g | 7.1 g | 95% | impossible | —% |
| 45 | 1000 g | 6.7 g | 90% | possible | 82% |
| 46 | 1000 g | 1.4 g | 20% | possible | 81% |
| 47 | 1000 g | 0.7 g | 10% | possible | 74% |
| 48 | 1000 g | 0.3 g | 4% | possible | 65% |

As can be seen from Table 1-12, when the mixing ratio of silica to the toner was between 10 and 90%, image transfer efficiency was high.

Embodiment 2

In the toners prepared in accordance with this embodiment of the invention, each toner particle has a plurality of conductive portions electrically floating on the surface of an insulating material. When this toner is used in a direct developing process, electric charges are accumulated in the toner that is in contact with the surface of an exposed image forming member through the conductive portion of the toner particles. When the toner image is electrostatically transferred, the accumulated charges are transferred to the recording medium only where the conductive portion is in contact with the recording medium and electrically connected to the conductive portion. The charges in the conductive portions are maintained and adhesiveness of the toner to a recording medium during electrostatic transfer is provided.

Figure 21:
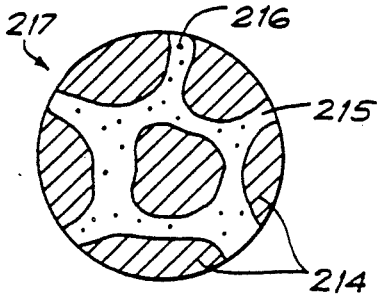
FIG. 21 is a top plan view of a toner particle constructed and arranged in accordance with a still further alternate embodiment of the invention.

Reference is made to FIG. 21 which shows a toner particle 217 which includes an insulating material 215 and a plurality of conductive materials 214 electrically floating on the surface of insulating material 215. All of the materials used in preparing toner 217 have a volume resistance of greater than about $10^8\Omega$ cm and may be used as insulating material in order to insure insulation between conductive portions 214.

Fine particles of an insulating magnetic material 216, generally $Fe_3O_4$ or $\gamma$-$Fe_2O_3$, are dispersed in insulating material 215. Insulating magnetic fine particles 216 are necessary in order to carry toner 217 from a toner supplied using a magnetic brush. Alternatively, the toner can be magnetized using conductive magnetic materials such as iron, cobalt and nickel in conductive portion 214.

Figure 22:
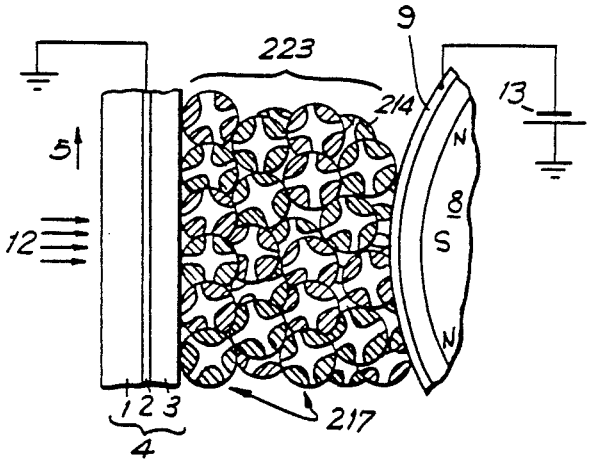
FIG. 22 is a diagram showing image formation by a direct developing process using the toner of FIG. 21 in the printer of FIGS. 1A and 1B.

FIG. 22 depicts image formation by a direct developing process using toner 217 in printer 23 of FIGS. 1A and 1B. Image forming member 4 includes transparent supporting base 1, transparent conductive layer 2 thereon and photoconductive layer 3 laminated on transparent conductive layer 2. Image forming member 4 moves in the direction of arrow 5 when image forming member 4 is subject to image exposing light 12. A toner layer 223 including toner particles 217 is carried by conventional magnetic brush of magnetic roller 8 and sleeve 9 and contacts image forming member 4 at exposed portions.

Bias voltage 13 is applied to sleeve 9 and electric charges are accumulated in toner 217 in contact with image forming member 4 through an electric current path formed by connections between conductive portions 214 of toner particles 217. The amount of accumulated charge is different in the exposed and unexposed portions of image forming member 4 and accordingly, the electrosatatic attractivity of toner 217 to the surface of photoconductive layer 3 also differs. An image is formed as a result of the greater electrostatic attractivity in the areas of exposure.

As toner layer 223 moves on image forming member 4, the relative positions of toner particles 217 change. Accordingly, the electric current path also changes. However, since there are many possible electric current paths between sleeve 9 and image forming member 4 through conductive portion 214 of toner 217, electric charge always accumulates in toner 217.

Figure 23:
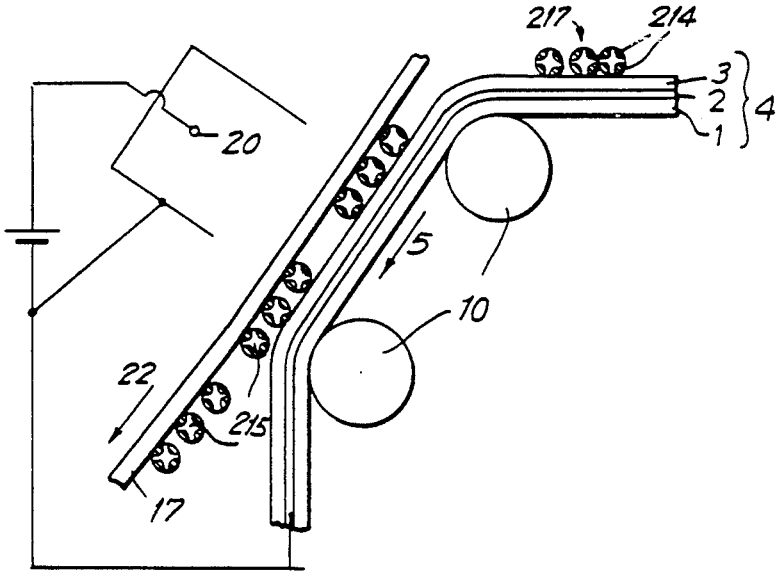
FIG. 23 is a diagram showing electrostatic transfer to a recording medium from the image forming member formed in accordance with FIG. 22.

FIG. 23 illustrates image transfer from image forming member 4 to recording medium 17 using toner 217. Recording medium 17 is placed on image forming member 4 on which a toner image has been formed. Ions having a polarity opposite to that of the electric charges of conductive portion 214 are deposited on the rear of recording medium 17 by corotron 20. Electric charges accumulated in conductive portion 214 in contact with recording medium 17 are instantly neutralized and do not transfer an image to recording medium 17. In contrast, since the electric charges from conductive portion 214 which remain in conductive portions 214 which are not in contact with recording medium 17, 215 have a longer discharge time, the charges produce an electrostatic force between toner 217 and recording medium 17 and the toner image is transferred to recording medium 17.

Figure 24A:
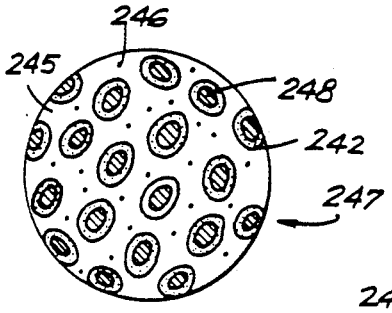
FIG. 24A is a perspective view showing a toner particle constructed and arranged in accordance with an alternate embodiment of the invention.
Figure 24B:
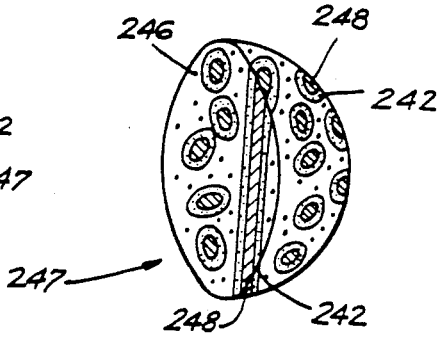
FIG. 24B is a cross-sectional perspective view of the toner particle of FIG. 24A.

FIGS. 24A and 24B show another example of a toner particle 247 in accordance with this embodiment. Toner 247 includes an insulating resin 245 having a pin-like conductive body 248 penetrating therethrough. Pin-like conductive body 248 has an insulating coating 242 on its side surfaces and functions as a conductive portion. Magnetic fine particles 246 are dispersed in insulating resin 245.

Pin-like conductive body 248 is generally pin-like fine particles of, for example, aluminum. These fine particles are obtained by a method in which a material is evaporated and recrystallized in an inert gas. Insulating coating 242 can be formed by coating the surface of pin-like conductive body 248 with an oxide film.

In order to magnetize toner 247, insulating magnetic fine particles 246 are dispersed in insulating resin 245. Alternatively, it is possible to use conductive magnetic material such as iron, cobalt and nickel as pin-like conductive body 248. In such a case, it would not also be necessary to disperse magnetic fine particles in the insulating resin.

By using this toner in which a conductive portion penetrates the toner particle, electric charges are accumulated in the toner during image formation effectively.

Embodiment 3

The combination toner of this embodiment includes a plurality of insulating portions and conductive portions on the particle surface. The conductive portions are formed of a P or N type semiconductor. By using this toner in a direct developing process, electric charges are accumulated in the toner in contact with the surface of the image forming member by movement of positive or negative carriers of the semiconductors. The adhesiveness of the toner to the recording medium is maintained by the charges on the insulating portion at the surface of the toner that has previously been electrified.

Figure 25:
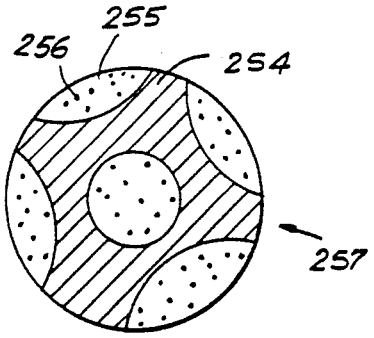
FIG. 25 is a plan view of a toner particle constructed and arranged in accordance with another embodiment of the invention.

FIG. 25 shows the structure of a toner particle 257 having a plurality of insulating portions 255 floating on the surface of a conductive portion 254. A P or N type semiconductor can be used as the conductive portion and a desirable type is selected depending on the polarity of photoconductive layer 3. A magnetic material 256 is dispersed in insulating portions 255.

In order to insure insulation between conductive portions 254, materials having a volume resistance of greater than about $10^8\Omega$ cm can be used. Conventional insulating magnetic fine particles 256 such as $Fe_3O_4$ or $\gamma$-$Fe_2O_3$ are dispersed in insulating portion 255. These fine particles 256 adhere toner 257 to sleeve 9 of the magnetic brush from toner supplier 7.

Figure 26:
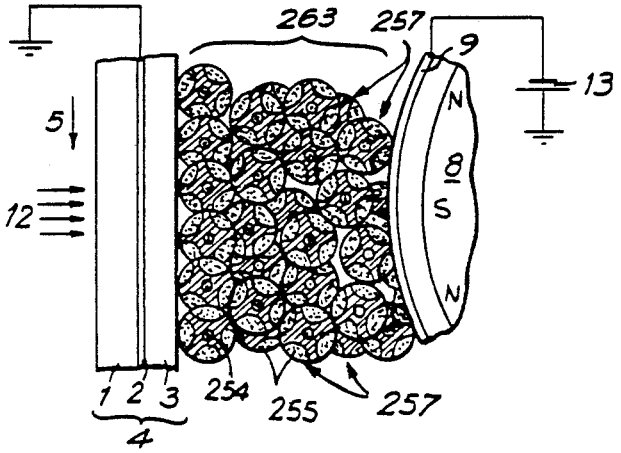
FIG. 26 is a diagram showing image formation by a direct developing process using the toner of FIG. 25 in the printer of FIGS. 1A and 1B.

Image formation by a direct developing process using toner 257 in printer 23 of FIGS. 1A and 1B is shown in FIG. 26. Image forming member 4 formed of transparent supporting base 1, transparent conductive layer 2 laminated thereon and photoconductive layer 3 laminated on transparent conductive layer 2. Image forming member 4 moves in the direction of arrow 5 when subjected to image exposing light 12. A toner layer 263 of toner particles 257 is carried by a conventional magnetic brush sleeve 9 of magnetic roller 8 and contacts image forming member 4 at an exposed portion.

Bias voltage 13 having a polarity selected with reference to the polarity of conductive portion 254 of toner 257 is applied to sleeve 9. Electric charges having the same polarity as the bias voltage accumulate in toner layer 263 that is in contact with image forming member 4. The amount of accumulated charge differs between the exposed and unexposed portions of image forming member 4 and accordingly, the electrostatic attractivity of toner 257 to the surface of photoconductive layer 3 varies in these portions. Since the electrostatic attractivity is greater in the exposed portions, a negative image is developed.

Figure 27:
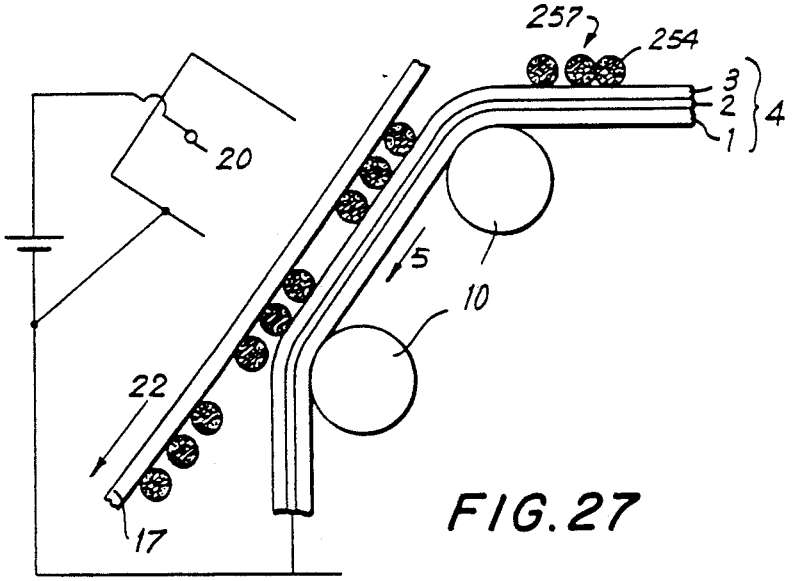
FIG. 27 is a diagram showing electrostatic transfer of the image formed in FIG. 26 to a recording medium.

Image transfer from image forming member 4 prepared as described in connection with FIG. 26 to recording medium 17 by an electrostatic transfer method is shown in FIG. 27. Recording medium 17 is placed on the surface of image forming member 4 on which the toner image has been formed and the rear surface of recording medium 17 is electrified to a polarity opposite to that of the electric charges of insulating portion 255 which is accumulated in toner 257 during image development.

The electric charges in conductive portion 254 of toner 257 in contact with recording medium 17 are instantly neutralized. Since the electric charges provided by coronatron 20 have a polarity opposite to that of insulative portion 255, an electrostatic force is produced between toner 257 and recording medium 17 which results in an image being copied.

Figure 28:
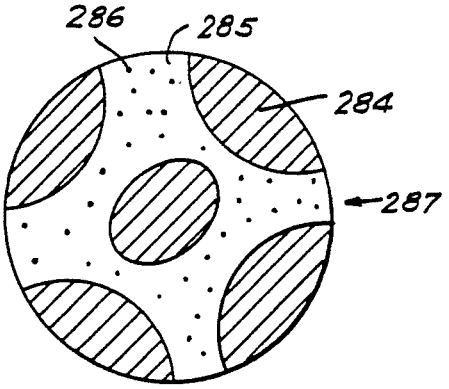
FIG. 28 is a plan view of a toner particle constructed and arranged in accordance with the invention.

Another toner particle 287 having a structure in accordance with this embodiment is shown in FIG. 28. Semiconductive N or P type fine particles 284 are buried in the surface of an insulating portion 285. Insulating magnetic fine particles 286 are also dispersed in insulating portion 285. Accordingly, even if the conductive portions are independent of each other, many electric current paths exist between the toner particles. During image formation such an insulating toner acts as a conductive toner.

A semiconductive fine powder can easily be obtained from vapor produced when P or N type monocrystalline silicon is sputtered. It is thus possible to convert conventional insulating toners to conductive toners having improved electrical properties in accordance with the invention.

Embodiment 4

In this embodiment, a toner having anisotropic electrical properties is used. When such a toner is used in a direct developing process, electric charges accumulate in the toner that is in contact with the surface of the image forming member through conductive linking of toner particles. At the time of image transfer, the toner particles act as an insulator when viewed from the side of the recording medium and toners are electrostatically transferred in order to form the image.

Figure 29A:
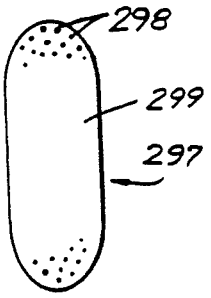
FIG. 29A is a plan view of a toner particle constructed and arranged in accordance with an alternate embodiment of the invention.
Figure 29B:
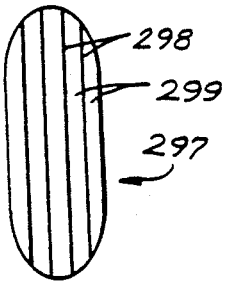
FIG. 29B is a cross-sectional view of the toner particle of FIG. 29A.

Toner particles 297 used in this embodiment of the invention are shown in FIGS. 29A and 29B. Toner particle 297 is substantially a rotating ellipsoid with pin-like conductive portions 298 disposed in the longitudinal direction. Pin-like conductive portions 298 are insulated from one another by an insulating material 299 in such a way that conductive portions 298 penetrate toner particle 297. Toner particle 297 is stable when lying on the longitudinal sides and unstable when the edges are oriented vertically or standing on edge. The anistropy of toner particle 297 is such that the toner is conductive when in the unstable position and insulating when in the stable position.

Insulating material 299 can be any conventional material used for an insulating toner. The material should have a specific resistance of at least about $10^8\Omega$ cm in order to prevent electric charge diffusion. Pin-like conductive material 298 is generally pin-like fine particles of aluminum or stainless steel. Such particles can be obtained by evaporation and recrystallization of the desired material carried in an inert gas.

Toner particles 297 must be magnetized by magnetic brush 9. Toner particles 297 can be magnetized by dispersing fine particles of an insulating magnetic material, such as $Fe_3O_4$ or $\gamma$-$Fe_2O_3$ in insulating material 299. Alternatively, pin-like conductive material 298 can be magnetized with iron, cobalt or nickel.

Figure 30:
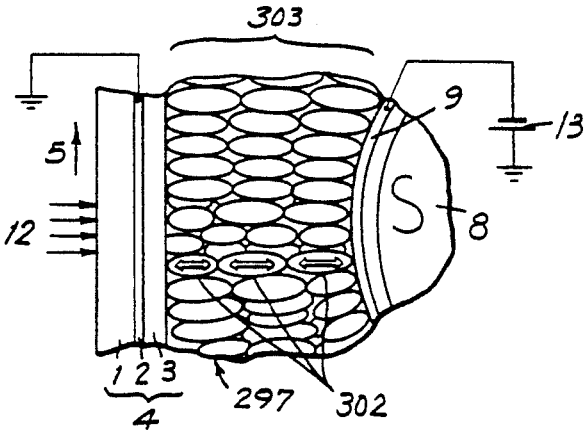
FIG. 30 is a diagram showing image formation by a direct developing process using the toner of FIGS. 29A and 29B in the printer of FIGS. 1A and 1B.

Image formation by a direct developing process using toner 297 in printer 23 of FIGS. 1A and 1B is illustrated in FIG. 30. Image forming member 4 includes transparent supporting base 1, transparent conductive layer 2 laminated thereon and photoconductive layer 3 laminated on transparent conductive layer 2. Image forming member 4 moves in the direction of arrow 5 when the member is subject to image exposing light 12.

A toner layer 303 of toner particles 297 is carried by a magnetic brush sleeve 9 of magnetic roller 8 and contacts image forming member 4 at the exposed portions. Bias voltage 13 applied to sleeve 9 causes electric charges to accumulate in toner particles 297 in contact with image forming member 4 through electric current paths made by contact between the conductive toner surfaces along a conductive direction 302. The amount of accumulated charge differs at exposed and unexposed portions of the surfaces of image forming member 4 and the electrostatic attractivity of toner particles 297 to the surface of photoconductive layer 3 increases at the exposed portions, thereby developing an image. As shown in FIG. 30, the alignment of toner particles 297 formed by magnetic brush 9 is in an aligned or a conductive position 302 as determined by the stabilizing principle of energy forming an electric current path.

Figure 31:
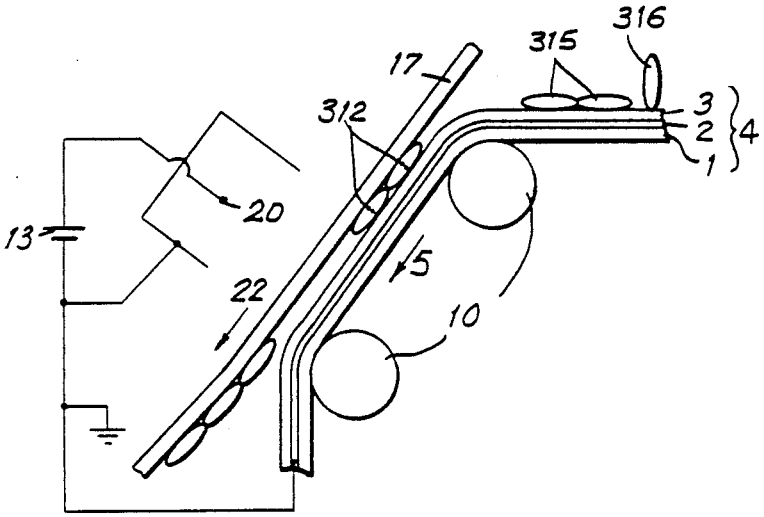
FIG. 31 is a diagram showing electrostatic transfer of the image formed in accordance with FIG. 30 to a recording medium.

Image transfer to recording medium 17 by an electrostatic transferring method using toner particles 297 formed on image forming member 4 in accordance with FIG. 30 is shown in FIG. 31. Recording medium 17 passes adjacent to the surface of image forming member 4 on which a toner image has been developed. Ions having a polarity opposite to that of the electric charges accumulated during image formation in the conductive portion of toner particles 297 are deposited on the rear surface of recording medium 17 by coronatron 20.

At this time, most of toner particles 297 on image forming member 4 have oriented to stable toner position 315 due to the stabilizing principle of energy during movement to the transferring position. The portion of toner particles 297 that have moved to the transferring position from unstable toner position 316 take position 315 when recording medium 17 is placed on image forming member 4. Specifically, since toner particles 297 contacting the surface of recording medium 17 are in an insulating direction 312 when viewed from the side of recording medium 17, toner particles 297 act as an electrified insulating material, producing an electrostatic force between toner particles 297 and recording medium 17. Accordingly, the image is transferred from image forming member 4 to recording medium 17.

As is clear from the image formation transfer and fixation process described, it is necessary for the discharge time of toner particles 297 when in unstable position 316 to be sufficiently shorter than the image formation period and the discharge time of the toner when in stable position 315 to be sufficiently longer than the period from image formation to the end of fixation. Since the developing nip is generally between about 2 and 3 mm and the distance between the formation portion to the outlet of the fixation portion is generally at least 30 mm, the volume resistance ratio between toner position 316 and 315 is preferably at least about 10.

Even when the shape of toner particle 297 is flat, advantageous properties can be obtained. For example, such a toner can be obtained by a method in which a resin containing carbon and the like dispersed therein is sheeted and both sides of the sheet are coated with silicon alkoxide, dried and pulverized.

Figure 32A:
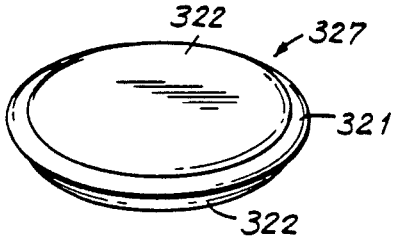
FIG. 32A is a perspective view of a toner particle constructed and arranged in accordance with an alternative embodiment of the invention.
Figure 32B:
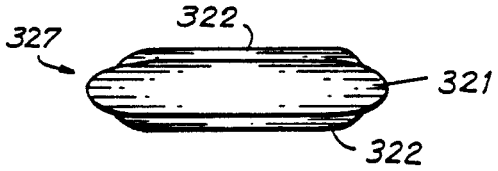
FIG. 32B is a cross-sectional view of the toner particle of FIG. 32A.

FIGS. 32A and 32B show another example of a toner particle 327 prepared in accordance with this embodiment of the invention. Toner 327 has a flat disk shape and includes a conductive member 321 that is exposed at the edges between two insulating members 322.

Toner 327 is prepared by dispersing conductive thermoplastic resin particles in a heat resistant solution maintained at a temperature greater than the melting point of the thermoplastic resin. The thermoplastic resin particles are passed through a space smaller than the particle diameter of the resin particle in order to elongate the particles and are quenched immediately after passing through the space. Then insulating resin particles are partially attached to the surface of the thermoplastic resin particles. The shape of the conductive thermoplastic resin can be changed easily by heating the resin to a temperature greater than its melting point.

The thermoplastic resin particles are then dispersed in a heat resistant solution in order to separate completely each conductive thermoplastic resin particle without cohesion. The heat resistant solution is effective for conducting heat and carrying particles making it possible for each toner particle to pass through a space smaller than its particle diameter as described.

The changed shape of the thermoplastic resin is fixed by quenching to yield flat particles. The stable state of the particle can be specified by the anistropy of the flat particle and insulating particles can be attached at a specific portion. Accordingly, it is possible to use the insulating and conductive properties of the toner in a direct developing process.

Predetermined amounts of thermoplastic resin, dyeing agent, conductive rate adjusting agent and magnetic material are mixed and dispersed using a kneading machine. The thermoplastic resin is styrene resin or polymers thereof, polyester, polyethylene, polypropylene, acrylic resin, polyvinyl acetate, polyurethane, polyamide, epoxy, polyvinyl chloride, polyvinyl butyral, rosin, modified rosin, polyterpene, phenolic resin, aliphatic series resin, aliphatic hydrocarbon resin, aromatic oil resin and chlorinated paraffin.

Carbon black or nigrosine can be used as the dyeing agent. Carbon black or a metallic powder can be used as the material for adjusting the conductive rate. Conventional magnetic materials such as magnetite, hematite, ferrite and the like or metal or alloys of iron, cobalt and nickel can be used. The kneaded materials also include a conductive rate adjusting agent that can increase the conductive rate within the extent of possible charge accumulation.

Figure 33A:
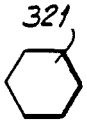
FIGS. 33A, 33B, 33C, 33D, 33E and 33F are diagrams showing the steps of preparation of the toner of FIGS. 32A and 32B.
Figure 33B:
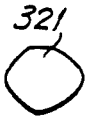

Reference is now made to FIGS. 33A to 33F wherein a process for making toner 327 is depicted. The kneaded materials are roughly ground, finely pulverized using a jet air flow mill and classified to yield uniform fine conductive particles of the type shown in FIG. 33A. The fine conductive particles are dispersed in a heat-resistant solution such as silicon or fluorine. The particles are flowable and become round by heating the heat-resistant solution to a temperature higher than the melting point of the conductive fine particles as shown in FIG. 33B.

Figure 33C:
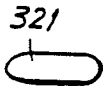

The heat-resistant solution is passed through a space smaller than the particle diameter of the fine conductive particles and is quenched at a temperature lower than the melting point of the particles immediately after passing through the space. The conductive fine particles are changed from a globe shape to a flat shape by crushing against each other in the space as shown in FIG. 33C. The space may be constructed by a cooled double roll for stably quenching conductive particles.

Figure 33D:
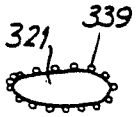
Figure 33E:
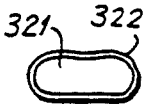
Figure 33F:
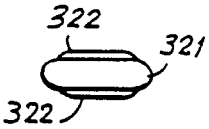

The conductive particles are removed from the heat-resistant solution. The particles have a disk shape and insulating particles 339 having a diameter of 1 μm are mixed and inserted in a ball mill in order to attach insulating fine particles 339 on the surface of conductive fine particles 321 as shown in FIG. 33D. Insulating fine particles 339 are melted in a hot air flow to increase the attraction between the surface of insulating fine particles 339 and conductive fine particles 321 and form insulating member 322 as shown in 33E. The insulating fine particles attached to the conductive fine particles are melted and strike against each other in ball mill and the insulating portion is removed at the end of the disk shaped conductive fine particles as shown in FIG. 32F to expose conductive resin at the ends of the disk. The insulating particles attached to the conductive particles often exposes the disk ends upon impact, thereby exposing the conductive resin without a separate removal step.

EXAMPLE 4–1

A mixture of 100 wt % of acrylic resin, 50 wt % of magnetite and 10 wt % of conductive carbon black was kneaded using a screw extruder, ground and classified to yield toner particles having a diameter of 9 to 13 μm. Carbon black was used as a dyeing agent. The resin had a specific resistance of $2\times10^4\Omega$ cm. The toner particles were dispersed in silicon oil having a heat resistance of 300° C. and heated to a temperature higher than the melting point of the acrylic resin. The toner particles became round and flowable.

The toner particles were passed through spaces between a double roll of 5 μm. The double roll was cooled to a temperature lower than the melting point of the particles while passing through the double roll. The toner particles acquired a disk shape having a diameter of about 10 to 18 μm and a thickness of about 5 μm. Acrylic resin particles having a diameter of 1 μm were mixed in equal weight percentages with toner in a ball mill for three hours to adhere the toner particles to the conductive particles. The adhered particles were treated in a hot air flow at a temperature of 500° C. in order to melt the surface of the acrylic resin conductive particles which are attached to the insulating acrylic resin. The toner is completed by treating the treated particles in a ball mill. Copy efficiency using a direct developing process was between 65% to 80% at a relative humidity of 70–40%.

Figure 34A:
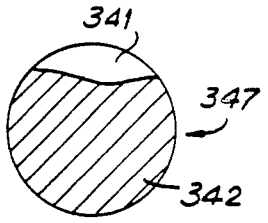
FIG. 34A is a plan view of a toner particle constructed and arranged in accordance with a further alternate embodiment of the invention.
Figure 34B:
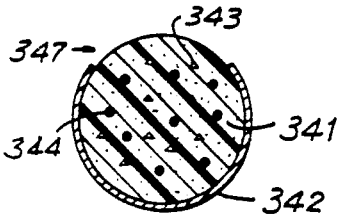
FIG. 34B is a cross-sectional view of the toner particle of FIG. 34A.

Another example of toner particles 347 prepared in accordance with this embodiment of the invention is shown in FIGS. 34A and 34B. Toner 347 has a continuous conductive layer 342 on more than 50% of the surface area of the toner core which is formed of an insulating resin 341. A pigment 344 and magnetic particles 343 are dispersed in resin 341. A property adjusting agent such as a charge control agent, an electric resistance control agent and a flow promoting agent is added to resin 341 or is disposed on the surface of resin 341. The specific resistance of resin 341 is greater than about $10^{12}\Omega$ cm and more preferably, is greater than about $10^{14}\Omega$ cm.

Conductive layer 342 is formed continuously on the surface of resin 341 and has a specific resistance of less than about $10^{12}\Omega$ cm and more preferably, less than about $10^{10}\Omega$ cm. The conductive layer covers an area greater than about 50% of the surface area of toner 347, in order to form a conductive path using a toner chain. The conductive layer covers an area less than about 80% of the surface area of toner 347 in order to prevent conductive layer 342 from attaching to paper during image formation.

Figure 35:
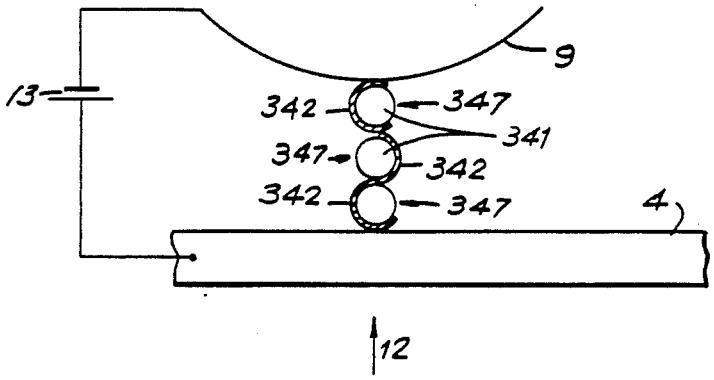
FIG. 35 is a diagram showing image formation by a direct developing process using the toner of FIGS. 34A and 34B in the printer of FIGS. 1A and 1B.

FIG. 35 illustrates image formation using toner 347 in a direct developing process using printer 23 of FIGS. 1A and 1B. Toner chains between sleeve 9 to which a bias voltage 13 has been applied and image forming member 4 form a conductive path by attaching conductive layers 342 to each other. When toner 347 is attached to the exposed portion of the photoconductive layer of image forming member 4, charges are accumulated in the leading portion of the toner and an electrostatic absorption force between photoconductive layer 3 and toner 347 is created to form an image.

Figure 36:
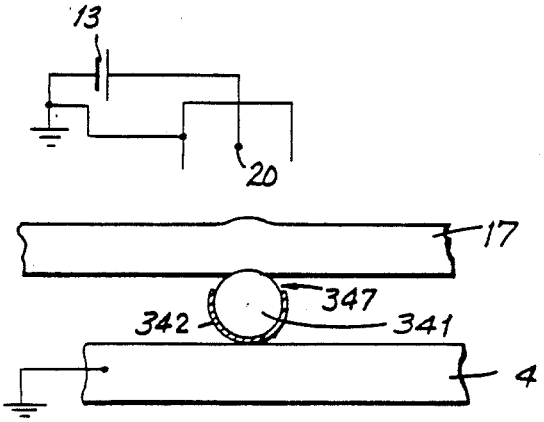
FIG. 36 is a diagram showing electrostatic transfer to a recording medium of the image formed in accordance with FIG. 35.

FIG. 36 illustrates image transfer of the toner formed in accordance with FIG. 35 by an electrostatic transfer method using the printer of FIGS. 1A and 1B. Recording medium 17 is placed on the image formed by toner 347 on image forming member 4. In this case, conductive layer 342 is on the side of image forming member 4 and when the area of conductive layer 342 is small, the charges stored on conductive layer 342 do not transfer to recording medium 17 so toner is transferred sufficiently. This process is performed most effectively when conductive layer 342 covers between about 50 and 80% of the surface area of toner particle 347. In fact, image transfer efficiency using the toner of this embodiment is markedly improved as compared with prior art conductive toners.

Addition of a toner having magnetic anistropy is also effective for forming a stable toner. If a magnetic axis is formed on a vertical line between the center portion of conductive layer 342 and the center portion of insulating surface portion 345, stable conductive chains are formed. Upon formation of stable conductive chains, the area of the conductive layer is reduced and the image is stably transferred.

In order to prepare a toner in accordance with this embodiment of the invention, resins, magnetic particles, pigments, flow promoting agents and charge control agents are mixed and dispersed. A conventional screw extruder may be used as a kneading device. The resin can be a polyester, polystyrene, polyethylene, acryl, epoxy or vinyl resin. The magnetic particles can be a magnetic powder such as $Fe_3O_4$ or $\gamma$-$Fe_2O_3$, chrome dioxide, nickel ferrite or iron alloy particles. The pigment can be carbon black, nigrosine or spirit black. The flow promoting agent can be particles of silicon oxide or titanium oxide. Several types of materials, specifically, complex materials having an electric charge reception capacity are used as charge control agents. If a uni-directional magnetic field is supplied to the materials as they exit the screw extruder by an electric magnet, the materials will have magnetic anistropy.

In order to grind and classify the materials, the materials are roughly ground using a stamp mill, finely pulverized using an air grinder and classified. Resin particles having a diameter of between about 5 and 15 $\mu$m are retained. The shape of the toner is basically a splinter, but toners having a relative round shape without any angles are obtained when an air grinder is used for an extended period. Toners having a rounder shape are obtained by exposing the toner to a hot air flow.

Figure 37:
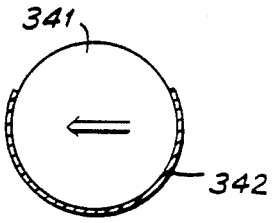
FIG. 37 is a diagram showing the easy axis of magnetization of the toner of FIGS. 34A and 34B.

The conductive layer consists of a metal film and is formed by vacuum evaporation. The material of the conductive layer can be any material that is useful in a vacuum evaporation process such as nickel or iron or a mixture thereof. A carbon conductive layer also has the same effect. The toner is carried by electrostatic absorption or by absorption of the magnetic incline using a plate or belt-like material. When a magnetic field is used and the direction of the magnetic incline is uniform, the direction of the easy axis of magnetization becomes uniform and the structure shown in FIG. 37 is obtained. The vacuum degree of vapor evaporation is approximately $10^{-5}$ Torr. However, it is possible to reduce the vacuum degree to approximately $10^{-4}$ Torr in order to deposit conductive material 342 on resin 341 entirely by vacuum. The condition of vapor evaporation can be controlled by the degree of vacuum. The vapor evaporation layer need not be thick and thicknesses between about 0.1 and 2 $\mu$m are suitable.

EXAMPLE 4–2

A mixture of 49 wt % of acrylic resin, 49 wt % of $Fe_3O_4$ and 2 wt % of nigrosine was mixed and evaporated on a copper-nickel alloy having a thickness of about 0.3 $\mu$m was deposited on approximately 70% of the surface area of the alloy to yield the toner. Direct developing process experiments were conducted using this toner at a relative humidity of 50%. An image transfer efficiency of 70% was achieved when the magnetic anistropy was non-uniform and an image transfer efficiency of 80% was achieved when the magnetic anistropy was uniform.

Embodiment 5

In this embodiment, the toner has a core that is primarily a binding resin, a dyeing agent and a magnetic material. A resin layer having a photoconductive agent dispersed therein covers the core. When this toner is used in a direct developing process, electric charges are accumulated in the toner that is in contact with the surface of the image forming member through the toner particles acting as a conductive toner. The conductive toner particles are formed by radiating a light to which the photoconductive agent is sensitive onto the toner during or immediately before image formation in order to form a conductive film on the surface of the toner particles. By transferring the image forming member in darkness, the conductivity is lost through use of infrared ray irradiation, heat or corona electrification. The particles that have lost their conductivity act as an insulating toner and are electrostatically transferred in order to form the image.

Figure 38:
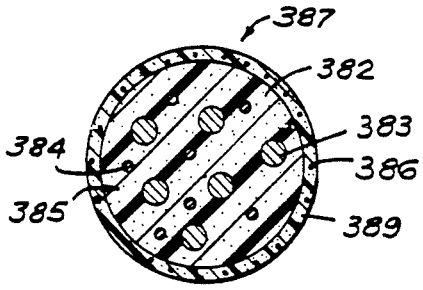
FIG. 38 is a cross-sectional view of a toner particle constructed and arranged in accordance with an alternate embodiment of the invention.

Reference is made to FIG. 38 wherein a toner particle 387 constructed and arranged in accordance with this embodiment of the invention is depicted. Toner 387 comprises a core material 385 of a binding resin 382 having a dyeing agent 383 and a magnetic material 384 dispersed therein. Core material 385 is completely surrounded by resin layer 389 having a photoconductive material 386 dispersed therein.

Figure 39:
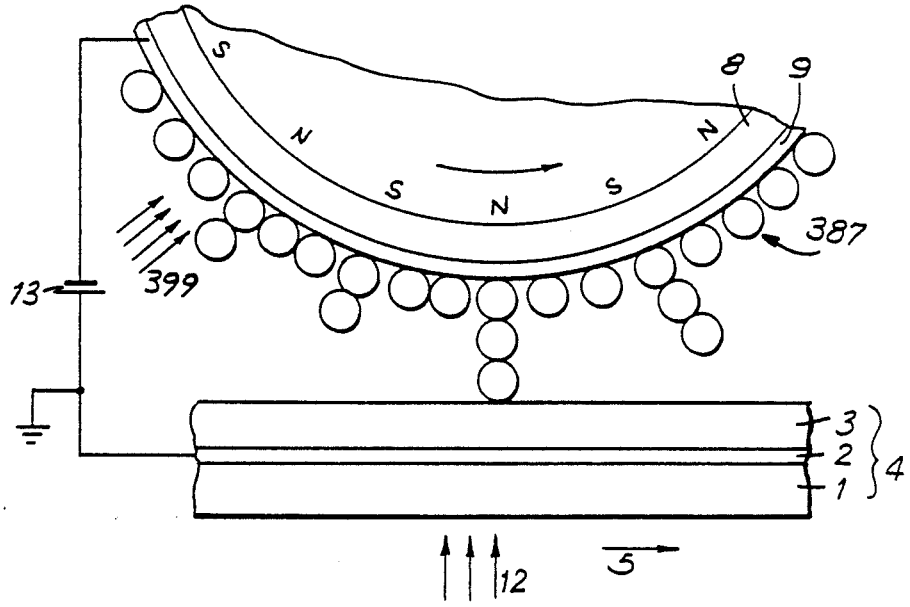
FIG. 39 is a diagram showing image formation by a direct developing processing using the toner of FIG. 38 in the printer of FIG. 1A and 1B.

Use of toner 387 in printer 23 of FIGS. 1A and 1B is illustrated in FIG. 39. Image forming member 4 includes transparent supporting base 1 having transparent conductive layer 2 disposed thereon and photoconductive layer 3 disposed on transparent conductive layer 2. Image forming member 4 moves in the direction of arrow 5 when it is subjected to image exposing light 12. Toner layer 387 attaches to image forming member 4 at an exposed portion by a conventional magnetic brush of a magnetic roller 8 and a sleeve 9.

Bias voltage 13 is supplied to sleeve 9 and since additional light 399 to which photoconductive material 386 is sensitive is radiated over sleeve 9, a conductive film is formed on the surface of toner 387. An electric charge accumulates in conductive film 386 and the amount of accumulated charge varies between the exposed and unexposed portions. The electrostatic attractivity of the toner of the surface of photoconductive layer 3 is different in exposed and unexposed portions, with the attractivity being greater in the exposed portions to form a negative image. It is to be understood that conductivity and image formation are performed by the same power source.

Figure 40:
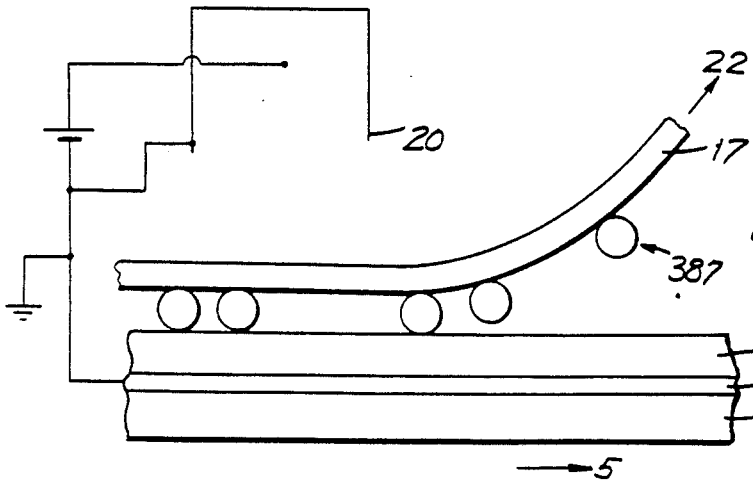
FIG. 40 is a diagram showing electrostatic transfer of the image formed on an image forming member in accordance with FIG. 39 to a recording medium.

FIG. 40 illustrates image transfer from image forming member 4 to recording medium 17 using toner 387 of FIG. 38 in the printer of FIGS. 1A and 1B. Image forming member 4 continues to move in the direction of arrow 5 and recording medium 17 is placed on the surface of image forming member 4 on which a toner image has been formed. Ions having a polarity opposite to that of the electric charge accumulated at the time of formation of the image are introduced to recording medium 17 by coronatron 20. Since toner 387 on image forming member 4 is maintained in darkness for a sufficient time to lose its conductivity and additionally by means of infrared ray irradiation, heat and corona electrification, the static force between recording medium 17 and image forming member 4 acts as a transfer force. Accordingly, the image is transferred onto the recording medium.

The thermoplastic resin is a conventional styrene resin or copolymer thereof, polyester, polyethylene, polypropylene, acrylic resin, polyvinyl acetate, polyurethane, polyamide, epoxy resin, polyvinyl chloride, polyvinyl butyral, rosin, modified rosin, terpene resin, phenol resin, aliphatic series resin, aliphatic hydrocarbon resin, aromatic oil resin, chlorinated paraffin and the like. Any of these resins can be used alone or in combination.

Carbon black, metallic powder, metal fiber and the like can be used as the conductive adjusting agent. Carbon black, nigrosine, $Fe_3O_4$ having a black color and the like can be used as the dyeing agent. Dyes or pigments and the like of other required colors can also be used. Compounds such as magnetite, hematite, ferrite, metals and alloys such as iron, cobalt, nickel and the like can be used as the magnetic agent. The optical conductive agent can be an inorganic material such as fluoroethylene, rosebengal, bromoflavine, malachite green, methylene blue, rosin, erythrosine, rhodamine B, bromophenol, brilliant blue, phloxin, crystal violet, xanthene series dye, phthalein series dye, triphenylmethane series dye, azo series dye and anthraquinoid dye. Any of these optical conductive agents can be used alone or in combination.

As the photoconductive agent, phthalocyanine pigment such as a metal free phthalocyanine, metal phthalocyanine and its halogen derivatives, perylene pigment such as perylene acid anhydride and bis-incoleperylene, anthraquinone, azo pigment such as monoazo and bisazo dyes, indigo pigment such as indigo-thioindigo pigment, quinacridone pigment, cyanin pigment including melo-cyanin and cyanin, polycyclic aroma pigments such as anthoanthrone, dibenzpyrenquinone, pyranethrone, violanthrone, iso-violanthrone, flavanthrene and organic photoconductive materials such as benzimidazole pigment and dioxane can be used.

A binding resin of a photoconductive material can be any of the thermoplastic resins discussed above as well as polyvinyl carbazole, polyphenyl anthracene, polyvinyl pyrazine, polyvinyl benzothiophene, polyvinyl pyrene and derivatives and copolymers thereof.

EXAMPLE 5-1

A mixture of 100 wt % of acrylic, 50 wt % of magnetite and 10 wt % of nigrosine was kneaded using a screw extruder, ground and classified to obtain toner particles having a diameter of between 9 and 15 μm. Then, 10 wt % of zinc oxide (ZnO), 0.4 wt % of rhodamine B, 10 wt % of styrene and 200 wt % of methylethylketone were dispersed uniformly in a solution of photoconductive agent and then dried by spraying. Accordingly, toner particles having a diameter of between about 10 and 20 μm were obtained using wind force classification.

Images having excellent gradients were obtained when these toners were used in a direct developing process.

Embodiment 6

The toner of this embodiment is a mixture of photoconductive toner particles having a specific resistance of less than about $10^8\Omega$ cm and insulating toner particles having a specific resistance of greater than about $10^9\Omega$ cm. The electrifying polarity and amount of electric charge that can be accumulated is controlled and insulating toner particles. In a preferred embodiment, the mixing ratio should be between about 1 part photoconductive toner particles to between about 0.1 and 10 parts insulating toner particles. The electric field which occurs during transfer of the image is such that an electrostatic force acts on the insulating toner particles in the direction of transfer from the image forming member to the recording medium.

When this toner is used to form an image, electric charge accumulates in the conductive toner particles in contact with the surface of the image forming member through paths of conductive toner particles that extend from the sleeve of the magnetic brush to the image forming member. Charge is accumulated by application of a bias voltage and the amount of charge corresponds to the degree of exposure of the image forming member. The difference in accumulated charge results in a difference in electrostatic attractivity of the conductive and insulating toner particles to the surface of the image forming member. Accordingly, an image of mixed conductive and insulating toner particles is formed on the surface of the image forming member. When the image is transferred, the toner particles that act as insulators when viewed from the side of the recording medium are electrostatically transferred in order to form the image.

Figure 41:
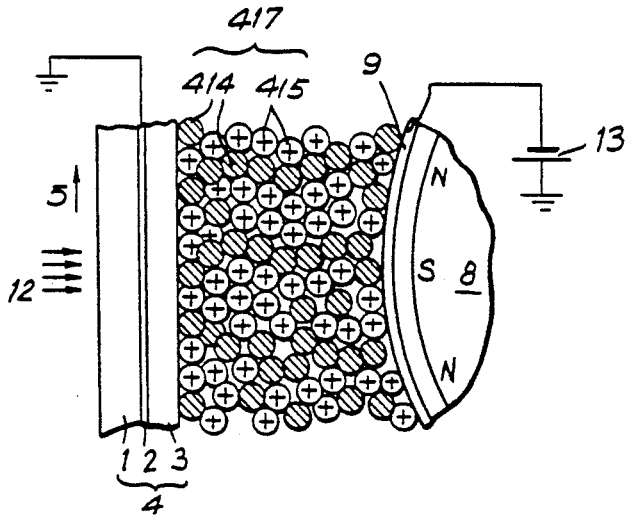
FIG. 41 is a diagram showing image formation by a direct developing process using a toner constructed and arranged in accordance with a further alternate embodiment of the invention in the printer of FIGS. 1A and 1B.

FIG. 41 illustrates image formation using the toner mixture of this embodiment in printer 23 of FIGS. 1A and 1B. Image forming member 4 includes transparent supporting base 1, transparent conductive layer 2 laminated thereon and photoconductive layer 3 laminated on transparent conductive layer 2. When image forming member 4 moves in the direction of arrow 5, image forming member 4 is subject to image exposing light 12. A conventional magnetic brush including magnetic roller 8 and a sleeve 9 transfers toner mixture 417 to image forming member 4 to form a toner layer 417.

Toner layer 417 is a mixture of conductive toner particles 414 and insulating toner particles 415. Toner layer 417 contacts image forming member 4 at the exposed portions by means of the magnetic brush. Bias voltage 13 is applied to sleeve 9 and charges accumulate in toner layer 417 by an electric current path formed by conductive toner particles 414. Since there are many possible electric current paths between sleeve 9 and image forming member 4 through conductive toner particles 414, there is no failure to accumulate electric charge. As toner mixture layer 417 is moved along on image forming member 4, the relative position of the toner particles changes and the electric current paths also change.

Since the materials of insulating toner particles 415 having a positive charge are of opposite polarity to the charge accumulated in conductive toner particles 414 at the time of image formation, an electric absorption force is generated between conductive toner particles 414 and insulating toner particles 415. On generation of this electric absorption force, charged photoconductive toner particles 414 are attached to the surface of image forming member 4. Insulating toner particles 415 are also attached to the surface of image forming member 4 and a toner image is formed using toner mixture 417.

Figure 42:
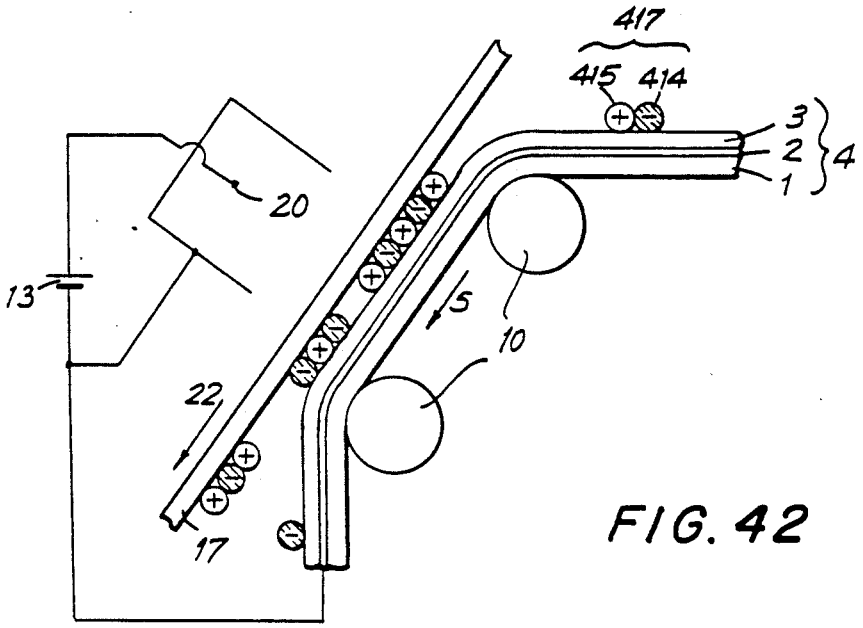
FIG. 42 is a diagram showing electrostatic transfer of an image formed in accordance with FIG. 41 to a recording medium.

As shown in FIG. 42, wherein image transfer by electrostatic transfer from image forming member 4 to recording member 17 using printer 23 of FIGS. 1A and 1B, recording medium 17 is placed on the surface of image forming member 4 on which an image has been formed as shown in FIG. 41. Ions having a polarity opposite to that of the negative charge at the surface of insulating toner particles 415 are deposited on the rear of recording medium 17 by coronatron 20. Accordingly, the electric field is such that an electrostatic force acts on insulating toner particles 415 in the direction from image forming member 4 to recording medium 17 to transfer insulating toner particles 415 to recording medium 17 by electrostatic transfer.

In addition, an electrostatic force also acts on conductive toner particles 414 in the direction from recording medium 17 to image forming member 4. Thus, conductive toner particles 414 do not transfer to recording medium 17 due to the charges deposited by coronatron 20. It has been found by experimentation that conductive toner particles 414 are partially transferred together with insulating toner particles 415 due to the attraction between insulating toner particles 415 and conductive toner particles 414.

At the time of image formation, it is necessary to accumulate charge in the conductive toner that is in contact with the surface of image forming member 4 quickly, preferably immediately on exposure of image forming member 4 to light. This is accomplished by the formation of paths of conductive toner particles extending from the toner supplier to the image forming member. It has been found that the specific resistance of the conductive toner should be less than about $10^8\Omega$ cm and should be at least one order of magnitude smaller than the resistance value of the low resistance toner. When the conductive toner has a resistance larger than this value, no image was formed.

At the time of transfer the image it is necessary to provide an insulating toner having a high electric resistance value in order to electrostatically transfer the insulating toner. It has been found that the insulating toner should have a specific resistance of greater than about $10^9\Omega$ cm. When the insulating toner has a resistance smaller than this value, abnormal transfer was caused when the image was electrostatically transferred.

It is also desirable that the ratio of insulating toner particles to conductive toner particles must not be large. When the ratio of insulating toner particles to conductive toner particles decreases, the ratio of conductive toner particles attached to the image forming member at the time of image formation decreases and the paths of conductive toner particles extending from the toner mixture supplier to the image forming member also decreases. As a result, it is difficult to form an image.

In contrast, if the ratio of insulating toner particles to conductive toner particles is too small, the ratio of insulating toner particles to conductive toner particles in the formed toner images decreases. Accordingly, the amount of toner electrostatically transferred onto the recording medium decreases and as a result, an image having a desired image density cannot be obtained. When the mixing ratios of conductive toner and insulating toner were varied in several experiments, it was found that the best ratio of conductive toner to insulating toner was between about 1 part conductive toner to between about 0.1 and 10 parts insulating toner.

Since the magnetic brush includes a magnetic roller and a sleeve, at least one of the conductive toner particles or the insulating toner particles must be magnetic. When magnetic conductive toner particles and nonmagnetic insulating toner particles were mixed, it was easy to form paths of conductive toner particles extending from the sleeve to the image forming member by magnetic force. Accordingly, such a toner is very effective for forming an image.

It is also possible to utilize both magnetic conductive toner particles and insulating toner particles. In this case, the magnetic force acts as an attractive force between the conductive and insulating particles at the time of image formation. Accordingly, the ratio of insulating particles to conductive particles in the toner image increases and the density of printed matter also increases. At the time of image formation, the toner mixture can also be modified so that electrostatic, chemical, mechanical forces and the like or some combination thereof can act as an attractive force between the conductive toner particles and the insulating toner particles to improve the properties and image quality.

EXAMPLE 6-1

A toner mixture that includes conductive toner particles and insulating toner particles was prepared. The conductive particles had a specific resistance of $10^3\Omega$ cm, an average particle diameter of 10 $\mu$m and a maximum magnetization of 40 emu/g. The insulating particles had a specific resistance of $10^{14}\Omega$ cm, a positive charge polarity, an average particle diameter of 10 $\mu$m and was not magnetized. The ratio of conductive to insulating toner particles was 1 to 2.

When this toner mixture was used in a direct developing process, excellent results were obtained in image formation and transfer.

EXAMPLE 6-2

A toner mixture including conductive toner particles having a specific resistance of less than $10^6\Omega$ cm and insulating toner particles having a specific resistance of $10^{13}\Omega$ cm were mixed in a ratio of 1 to 0.1 to 5. The electric field applied during image transfer was such that electrostatic forces acted on the conductive toner particles in the direction from the image forming member to the recording medium.

Figure 43:
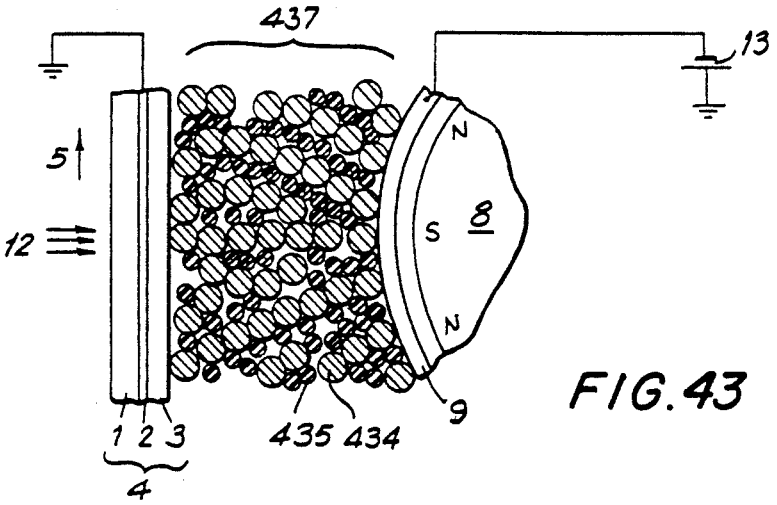
FIG. 43 is a diagram showing image formation by a direct developing process using a toner constructed and arranged in accordance with a further alternate embodiment of the invention in the printer of FIGS. 1A and 1B.

FIG. 43 illustrates image formation using a toner mixture 437 in printer 23 of FIGS. 1A and 1B in a device identical to FIG. 42. Toner mixture 437 is a mixture of insulating toner particles 435 and conductive toner particles 434 attached to image forming member 4 at an exposed portion using a conventional magnetic brush consisting of a magnetic roller 8 and a sleeve 9.

Since bias voltage is applied to sleeve 9, toner particles 434 and 435 are dispersed by rotation of magnetic roller 8 or sleeve 9, the charge accumulated from sleeve 9 in toner mixture 437 attached to image forming member 4 is determined by the polarity of the bias voltage. Accordingly, the amount of accumulated charge differs between the exposed and unexposed portions of image forming member 4. As a result, the electrostatic attractivity of toner mixture 437 to the surface of photoconductive layer 3 differs between these portions and an image is developed. Insulating toner particles 435 are attached to conductive toner particles 434 by forces exerted on the particles including surface tension, electrostatic and molecular interactions and the like. Accordingly, insulating toner particles 435 move with conductive toner particles 434 onto image forming member 4.

In addition, electrostatic attractivity is increased by arranging insulating toner particles 435 above or below conductive toner particles 434, by generating electrostatic forces by creating a frictional charge between insulating toner particles 435 and photoconductive toner particles 434 and other members in the developer, or by changing the charge polarity to a polarity opposite to that of the charge accumulated in photoconductive toner particles 434 at the time of image formation. Furthermore, since both photoconductive toner particles 434 and insulating toner particles 435 can be magnetic, they can be attracted to each other by magnetic forces.

Figure 45:
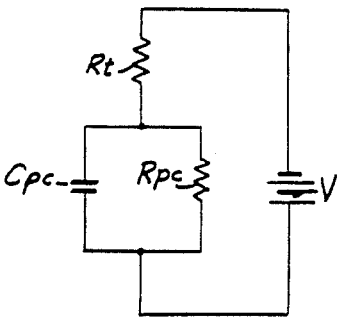
FIG. 45 is a circuit diagram for the circuit used to estimate the time required to accumulate a charge in a conductive toner.

The resistance value of the photoconductive toner particles is determined by the interval of charge accumulation. The length of the charge accumulation period is determined by the equivalence circuit shown in FIG. 45. Cpc is the electrostatic capacity of the photoconductive member per unit area, Rpc is the resistance value of the photoconductive member per unit area, and Rt is the resistance value of the toner layer per unit area. The time constant for accumulating the charge to capacity Cpc is $\tau$, which is determined by the formula:

$$\tau = Cpc \times (Rpc/1Rt)$$

wherein Rt is a connection in parallel.

When the photoconductive member has a specific dielectric constant of 3, a specific resistance at the time of light irradiation of $10^{10}\Omega$ cm and a thickness of 20 $\mu$m, Cpc equal $1.3\times10^{-10}$F./cm$^2$ and Rpc equals $2.0\times10^{7}\Omega$ cm$^2$. When the period of exposure is 2 msec, $\tau$ must be less than or equal to 2 msec. Accordingly, Rt must be less than or equal to $10^{6}\Omega$ cm$^2$.

When the effective thickness of the toner layer is approximately 200 $\mu$m, the volume resistance value is calculated as $2\times10^{8}\Omega$ cm. Therefore, in order to accumulate charge within the period of exposure, the toner must have a specific resistance of at least $10^{6}\Omega$ cm. If the increased resistance ratio of the mixture of insulating and conductive toners is cancelled by dispersing the mixture in a toner carrying medium, the conductive toner must have a specific resistance of at least $10^{6}\Omega$ cm.

Figure 44:
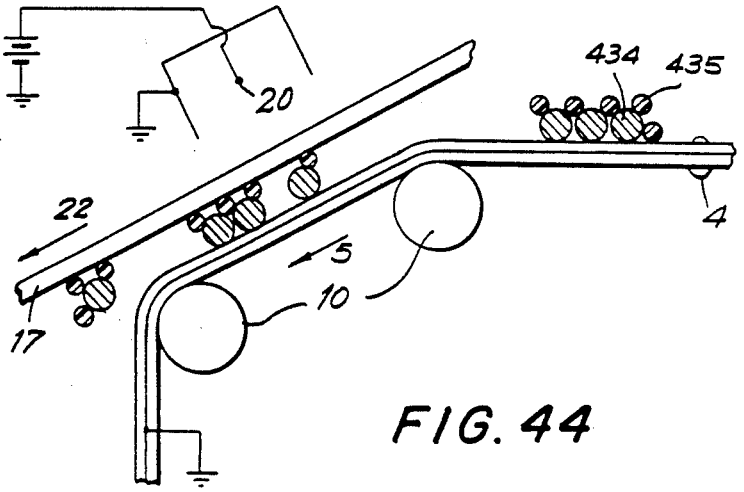
FIG. 44 is a diagram showing image formation by electrostatic transfer of an image formed in accordance with FIG. 43 to a recording medium.

FIG. 44 illustrates image transfer by an electrostatic transfer method using a toner mixture 437 of conductive toner particles 434 and insulating toner particles 435 in printer 23 of FIGS. 1A and 1B. Recording medium 17 is placed on the surface of image forming member 4 on which a toner image has been formed and charges having a polarity opposite to that of charges accumulated in image forming are deposited on the rear of recording medium 17 by coronatron 20. As a result, toner mixture 437 is transferred to recording medium 17 from photoconductive layer by the electrostatic force generated between toner mixture 437 and the charges on the rear of recording medium 17.

The electric charge of conductive toner particles 434 attached to recording medium 17 is instantly neutralized and charges are transferred from recording medium 17 to conductive toner particles 434 by the electric transfer field and conductive toner particles 434 are dispersed. The amount of conductive toner particles 434 attached to recording medium 17 decreases due to the large amount of insulating toner particles 465. Accordingly, the charge ratio of conductive toner particles 434 transferred from recording medium 17 decreases, the amount of dispersed toner decreases and image transfer is improved.

In view of the experimental data related to the effective image transfer ratio of a single component magnetic toner of the type used in Carlson's Process and described by Nakajima et al, Electric Photo Academy, 44th Study Forum, Draft p. 25 (1979), a mixed toner should have a specific resistance of greater than about $10^{13}\Omega$ cm. At the time of transfer, the toner mixture is maintained in a stationary state and the resistance value of the toner mixture is determined by the resistance value of the insulating toner portion. Accordingly, the resistance value of the insulating toner particles should be greater than about $10^{13}\Omega$ cm.

With respect to the mixing ratio of conductive to insulating toner particles, as the amount of insulating toner increases, the charge accumulated during development decreases. Accordingly, it is desirable for the ratio of the insulating to conductive portions to be less than about 5. In contrast, as the amount of insulating toner particles decrease, the amount of charge having a polarity opposite to that of the accumulated charge increases in image transfer. As a result, it is desirable for the ratio of insulating to conductive toner particles to be greater than about 0.1.

EXAMPLE 6-3

A toner mixture including a conductive toner portion and an insulating toner was prepared. The conductive toner particles have a specific resistance of $10^{3}\Omega$ cm, an average particle diameter of 10 $\mu$m and a maximum magnetization of 40 emu/g was prepared. The insulating toner particles had a specific resistance of $10^{14}\Omega$ cm, an average particle diameter of 10 $\mu$m and a maximum magnetization of 20 emu/g. The ratio of insulating toner particles to conductive toner particles was 2 to 1.

When this toner was used for image transfer using printer 23 of FIGS. 1A and 1B, excellent toner formation and transfer were obtained.

EXAMPLE 6-4

A toner mixture including a conductive toner portion and an insulating toner portion was prepared. The conductive toner particles had a specific resistance of $10^4\Omega$ cm, an average particle diameter of 10 μm and a maximum magnetization of 40 emu/g. The accumulated charge during image formation was negative. The insulating toner particles had a specific resistance of $10^{14}\Omega$ cm, an average particle diameter of 3 μm and a positive charge polarity. The ratio of the amount of conductive particles to insulating particles was 1 to 1. When image transfer was attempted by a direct developing process using printer 23 of FIGS. 1A and 1B, excellent toner formation and transfer were obtained.

The mixture of magnetic toners is preferably formed on a conductive toner portion having a specific resistance of less than about $10^8\Omega$ cm and an insulating toner portion having a specific resistance of greater than about $10^9\Omega$ cm with a controlled electrical polarity and degree of electrification. The mixing ratio is preferably between about 1 part conductive toner particles to about 0.1 and 10 parts insulating toner particles by weight. When bias voltage is applied to the toner mixture to form an image, a charge having the same polarity as the insulating toner accumulates in the conductive toner particles. The electric field existing during image transfer causes a static force to act on the insulating toner particles in the direction from the image forming member to the recording medium.

Figure 46:
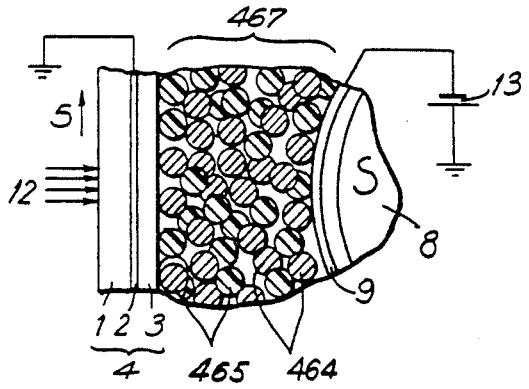
FIG. 46 is a diagram showing image formation by a direct developing process using a toner constructed and arranged in accordance with a further alternate embodiment of the invention in the printer of FIGS. 1A and 1B.

A direct developing process using such a toner mixture 467 in printer 23 of FIGS. 1A and 1B is shown in FIG. 46 and is identical in structure to that previously described. Toner mixture 467 includes conductive toner particles 464 and insulating toner particles 465. Toner mixture 467 attaches to image forming member 4 at exposed portions using a conventional magnetic brush consisting of a magnetic roller 8 and a sleeve 9 as described above.

Since bias voltage 13 was applied to sleeve 9, which is constructed of a non-magnetic material, the charge from sleeve 9 is transferred to toner mixture 467 attached to image forming member 4 through current paths formed using conductive toner particles 464. As toner mixture 467 moves along image forming member 4, the relative positions of the toner particles changes and the electric current paths also change. However, since there are many possible electric current paths between sleeve 9 and image forming member 4 through conductive toner particles 464, failure to accumulate electric charge in toner mixture 467 does not occur.

Since insulating toner particles 465 has the same charge polarity as the negative charge in conductive toner particles 464, electrostatic attraction occurs between both toner particles 464 and insulating toner particles 465. In this particular example, both insulating toner particles 465 and conductive toner particles 464 are magnetic and are positioned in a magnetic field of magnet 8. Accordingly, conductive toner particles 464 and insulating toner particles 465 are attracted to each other. Since insulating toner particles 465 is in close proximity to conductive toner particles 464, insulating toner particles 465 are also attached to the surface of image forming member 4. As a result, a mixed toner image consisting of conductive toner particles 464 and insulating toner particles 465 is formed on image forming member 4 when conductive toner particles 464 are attached to the surface of image forming member 4.

Since photoconductive layer 3 is insulative at unexposed portions, the charge accumulated in conductive toner particles 464 is minimized by bias voltage 13 during development. Since the attraction of insulating toner particles 465 to image forming member 4 depends on the previous charge of the insulating toner portion, an appropriate magnetic absorption force can prevent toner attractivity. In addition, insulating toner particles 465 can have a charge of a desired polarity as a result of frictional forces existing between insulating toner particles 465 and sleeve 9. Furthermore, insulating toner particles 465 is charged in advance in order to carry toner mixture 467 from toner supplier 6 to image forming member 4.

Figure 47:
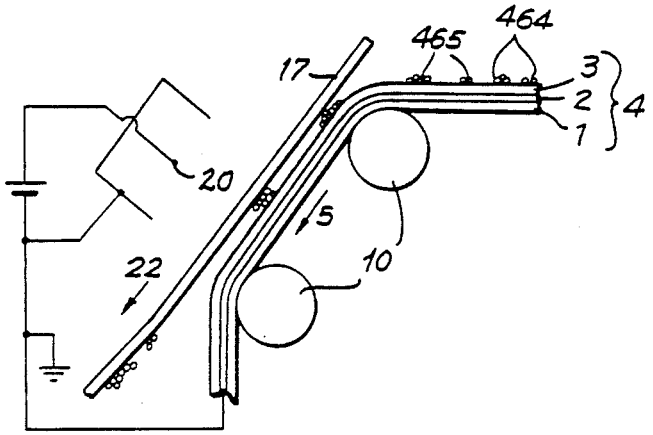
FIG. 47 is a diagram showing electrostatic transfer of the image formed in accordance with FIG. 46 to a recording medium.

Toner image transfer by an electrostatic transfer method from image forming member 4 to recording medium 17 using printer 23 of FIGS. 1A and 1B is shown in FIG. 47. Recording medium 17 is placed on image forming member 4 on which a toner image has been formed and ions having a polarity opposite to those of the electric charges in conductive toner particles 464 of toner mixture 467 are deposited on the rear of recording medium 17 by coronatron 20. Accordingly, the electric field during image transfer is such that an electrostatic force acts on conductive toner particles 464 in the direction from image forming member 4 to recording medium 17 and the toner image is transferred. The charges of conductive toner particles 464 in the toner image are neutralized by attachment of toner mixture 467 on the exposed portion of image forming member 4. The time required to neutralize the charge is a function of the discharge period of conductive toner particles 464 and is determined by both the resistance value and the dielectric constant of image forming member 4 and conductive toner particles 464. Even though the amount of accumulated charge in toner mixture 467 decreases, the magnetic absorption force between conductive toner particles 464 and insulating toner particles 465 still exists and conductive toner particles 464 is transferred onto recording medium 17 together with insulating toner particles 465. The absorption force between conductive toner particles 464 and recording medium 17 decreases by run-off of the charge to recording medium 17 after transfer and accumulation of the ion charge supplied by coronatron 20. Conductive toner particles 464 is maintained on recording medium 17 by magnetic absorption force and is unaffected by repulsion forces.

At the time of image formation, it is necessary to accumulate charges in the conductive toner portion in contact with the surface of image forming member immediately upon exposure of the image forming member to exposing light. This is accomplished by forming paths of conductive toner particles extending from the toner supplier to the image former. It has been found by experimentation that the specific resistance of the conductive toner must be less than about $10^8\Omega$ cm and less than the specific resistance of the low resistance toner by at least one order of magnitude. When the conductive toner portion with a resistance value larger than this value, no image was formed.

Furthermore, at the time of image transfer, it is necessary to provide an insulating toner having a high degree of electrical resistance in order to transfer electrostatically the insulating toner particles with the conductive toner particles. By experimentation it was found that the specific resistance of the insulating toner portion should be at least $10^9\Omega$ cm. When the insulating toner portion has a resistance smaller than this value, abnormal transfer was caused during electrostatic transfer.

When the ratio of the amount of insulating toner portion to conductive toner portion is too large at the time of image formation, the amount of the conductive toner portion which attaches to the image forming member decreases. Accordingly, the trains of conductive toner particles extending from the toner supplier to the image forming member also decrease and it is difficult to form an image.

In contrast, if the ratio of the amount of insulating toner to conductive toner is too small, the amount of insulating toner in the formed toner image decreases. Accordingly, the amount of toner electrostatically transferred to the recording medium decreases and an image having the desired density cannot be obtained. It was determined by experimentation that the ratio of the conductive toner portion to insulating toner portion should be between about 1 part conductive toner particle to between about 0.1 and 10 parts insulating toner particles by weight.

It is also necessary for magnetic absorption forces to act mutually on the conductive toner particles and the insulating toner particles and a magnetic force must be provided to the toner supplier. Accordingly, a magnetic conductive toner and a magnetic insulating toner are used.

Typical of constructions of toner mixtures of this example include a conductive toner portion having a specific resistance of $10^3\Omega$ cm, an average particle diameter of 10μm and a maximum magnetization of 40 emu/g and an insulating toner portion having a specific resistance of $10^{14}\Omega$ cm, an average particle diameter of 10 μm, a positive charge polarity and a maximum magnetization of 20 emu/g. The ratio of the conductive toner portion to insulating toner portion is preferably about 1 to 2 by weight. Excellent toner formation and transfer can be obtained using such a toner in a direct developing process.

Embodiment 7

The toner of this embodiment of the invention includes a wax. When such a toner is used in a direct developing process, electric charge is accumulated in the toner that is in contact with the surface of an image forming member through a conductive portion of the toner particles. When the image is transferred, the wax in the toner particles is melted by heat and the viscosity of the melted wax adheres the toner particles on the surface of a recording medium.

FIG. 48 shows a toner particle 487 prepared in accordance with this embodiment. Toner particle 487 includes a magnetic powder 489, a pigment 486 and a wax 488 dispersed in a binding resin 485.

Conventional resins such as polystyrene, polyester and acrylic resins can be used as binding resin 485. Magnetic powder 489 can be iron, cobalt and nickel or metal such as ferrite and magnetite. Pigment 486 can be carbon black, spirit black, nigrosine and the like. Finally, wax 488 can be an animal wax, vegetable wax, metallic wax, microcrystalline wax and the like.

EXAMPLE 7-1

A toner was prepared using the following materials;

| | |
|---|---|
| Polystyrene | 40 wt % |
| $Fe_3O_4$ | 40 wt % |
| Montan wax | 18 wt % |

-continued

| | |
|---|---|
| Carbon black | 2 wt % |

The toner was prepared by mixing the materials, kneading the mixture in a screw extruder, setting the kneaded materials by cooling, roughly grinding the cooled materials using a stamp mill and classifying the ground materials to a size of 10 μm. A cross-sectional view of a toner particle was observed using a transfer electron microscope (TEM), it was found that wax existed on the surface of the toner or in the inner portion at a predetermined ratio.

FIG. 49 illustrates image formation by a direct developing process using toner particles 487 of FIG. 48 in printer 23' of FIGS. 2A and 2B. Image forming member 4' includes transparent supporting base 1', transparent conductive layer 2' laminated thereon, and photoconductive layer 3' laminated on transparent conductive layer 2'. Image forming member 4' moves in the direction of arrow 5' when image forming member 4' is subjected to image exposing light 12'. Toner layer 493 of toner particles 487 contacts image forming member 4' at an exposed portion by use of a conventional magnetic brush of magnetic roller 8' and sleeve 9'.

Since bias voltage 13' is applied to sleeve 9', the charge from sleeve 9' accumulates in conductive toner particles 487 attached to image forming member 4' through a current path formed by a path of conductive toner particles 487 extending from sleeve 9' to image forming member 4'. The amount of accumulated charge differs between the exposed and unexposed portions of member 4' and accordingly, the electrostatic attractivity of toner particles 487 to the surface of photoconductive layer 3' also differs. As a result, an image is formed.

As toner layer 493 moves on image forming member 4', the relative positions of toner particles 487 change. Accordingly, the electric current paths also change. However, since there are many possible electric current paths between sleeve 9' and image forming member 4' through the conductive portion of toner particles 487, electric charge is accumulated without fail.

Figure 50:
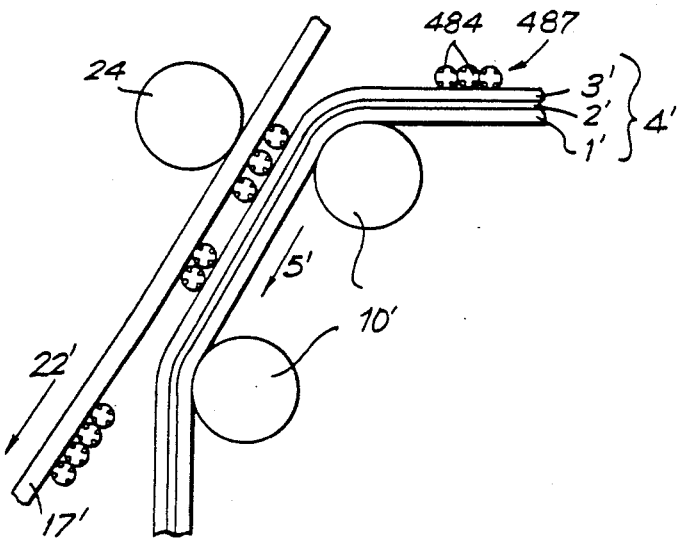
FIG. 50 is a diagram showing thermal transfer of an image formed in accordance with FIG. 49 to a recording medium.

FIG. 50 illustrates image transfer by a thermal transfer method using toner 487 of FIG. 48 in printer 23' of FIGS. 2A and 2B. Recording medium 17' is placed above the surface of image forming member 4' on which a toner image has been formed. Heat at a temperature between about 40° and 50° C. is conducted to toner particles 487 from the rear of recording medium 17' by heated roller 24. Accordingly, wax 488 in toner particles 487 is melted and dissolved. The adhesiveness between wax 488 and recording medium 17' acts as a transfer force. In addition, flush heating using infrared heat may be used as a heating means in place of heat roll 24. Finally, the toner image is fixedly transferred onto plain paper by passing through a pair of stable rollers 21' as shown in FIG. 2A.

Figure 51:
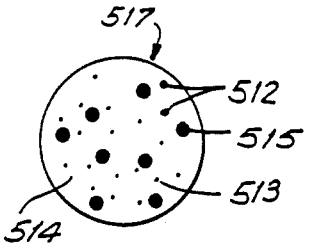
FIG. 51 is a plan view of a toner particle constructed and arranged in accordance with another embodiment of the invention.

Another example of a toner particle 517 prepared in accordance with this embodiment including a wax mass 515 scattered on the surface of a conductive material 514 in which a magnetic material 512 and a dye 513 are dispersed is shown in FIG. 51. Wax masses 515 are formed by including fine particles of a foaming agent having a decomposition temperature higher than the melting point of a binding resin in a conductive resin portion. The conductive resin portion is heated to decompose the foaming agent and produce foams. Finally, the foams are filled with wax, fat or the like.

Figure 52:
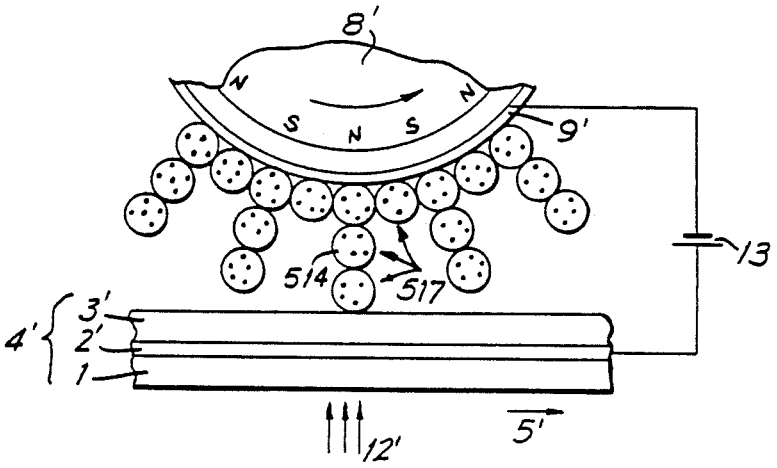
FIG. 52 is a diagram showing image formation by a direct developing process using the toner of FIG. 51 in the printer of FIGS. 2A and 2B.

Image formation using toner particles 517 of FIG. 51 in a direct developing process is shown in FIG. 52. As shown in FIG. 52, the printer 23' of FIGS. 2A and 2B is used as described in connection with FIG. 49. Toner particles 517 are carried by a sleeve 9' and attach to image forming member 4' at exposed portions.

Since bias voltage 13' is applied to sleeve 9', electric charges accumulate in toner particles 517 that are in contact with image forming member 4' through conductive material 514. The amount of accumulated charge differs between the exposed and unexposed portions of image forming member 4' and accordingly, the electrostatic attractivity of toner particles 517 to the surface of photoconductive layer 3' also differs. As a result, an image is formed.

Figure 53:
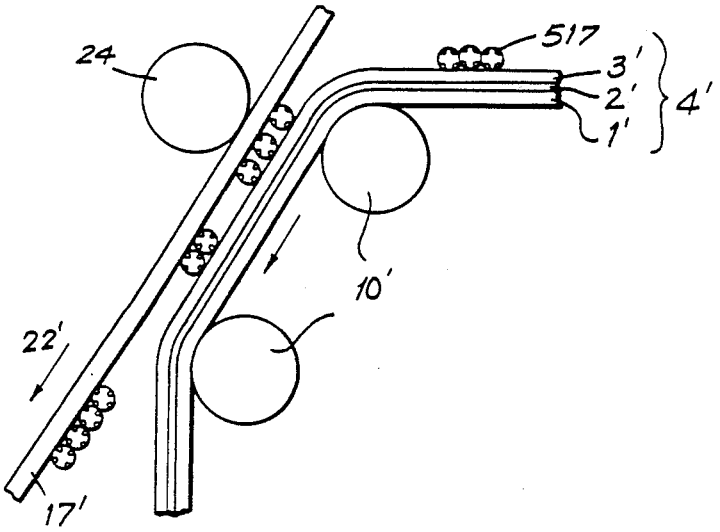
FIG. 53 is a diagram showing thermal transfer of an image formed in accordance with FIG. 52 to a recording medium.

Image transfer from image forming member 4' prepared in accordance with FIG. 52 is shown in FIG. 53. The toner image is prepared by placing recording medium 17' above the surface of image forming member 4' on which a toner image has been formed. Heat at a temperature between about 40° and 50° C. is conducted to toner particles 517 directly by heat roll 24 located at the rear of recording medium 17'. Accordingly, the wax in the toner is softened or resolved and the toner is adhered to recording medium 17' as a result of the transfer force. Alternatively, a flush heating means using infrared heat can be used in place of heat roll 24. Finally, the copied toner image is fixedly transferred onto plain paper by used of a heat fixing roller.

EXAMPLE 7-2

45 wt % of acrylic resin used as a binding resin, 45 wt % of $Fe_3O_4$ used as a magnetic powder, 9.9 wt % of carbon black used as a dye and 0.1 wt % of azodicarbonamide (ADCA) having an average particle diameter of 0.08 μm were mixed, kneaded and heated to 210° C. using a screw extruder. A section of the material was observed using an electron microscope and the diameter of foam contained therein was between about 0.1 and 3 μm. The average diameter was 0.6 μm. The foams had an opening rate of 30%.

The material was soaked in wax having a melting point of 50° C. and ground on the surface. The materials were further roughly ground using a stamp mill, pulverized using a jet mill and classified using a dry air-flow classifier in order to yield conductive magnetic particles having a diameter between about 5 and 20 μm.

The toner had the following physical properties:

| | |
|---|---|
| Specific resistance | $5 \times 10^8$ Ωcm |
| Angle of repose | 40° |
| Saturation magnetization | 35 emu/g |
| Average particle diameter | 10.9 μm. |

The image transferring efficiency of this toner using a direct developing process at 40% relative humidity and 20° C. was 83%.

EXAMPLE 7-3

45wt % of acrylic resin used as a binding resin, 45 wt % of $Fe_3O_4$ used as a magnetic powder, 9.9 wt % of carbon black used as a dye and 0.1 wt % of azodicarbonamide (ADCA) were mixed. Table 7-1 shows the results of transfer tests using samples prepared by the method of Example 7-2.

TABLE 7-1

| Diameter of ACDA particles | Diameter of foams (μm) | Specific resistance of toner (Ωcm) | Efficiency % | DDP |
|---|---|---|---|---|
| 1.0 | 7.4 | $2.9 \times 10^{10}$ | 42 | impossible |
| 0.5 | 3.7 | $1.0 \times 10^{10}$ | 72 | possible |
| 0.1 | 0.7 | $7.1 \times 10^8$ | 79 | possible |
| 0.05 | 0.4 | $3.5 \times 10^6$ | 81 | possible |
| 0.01 | 0.1 | $2.1 \times 10^4$ | 69 | possible |

EXAMPLE 7-4

45 wt % of $Fe_3O_4$ used as a magnetic powder, 9 wt % of carbon black, 45 wt % of acrylic resin and 0.1 wt % of ADCA having a particle diameter of 0.08 μm were mixed. Toner particles were obtained using the method of Example 7-2. Table 7-2 shows the average diameter of the foams, the opening rate of the foams, the specific resistance of the toner, image transfer efficiency using a direct developing process under conditions of 40% relative humidity and 20° C. and the evaluation of the toner's utility as a transfer medium.

TABLE 7-2

| Composition | | Foam | | Specific | | |
|---|---|---|---|---|---|---|
| Acrylic | ADCA | Average | Opening | resistance | Efficiency | |
| (wt %) | (wt %) | diameter | rate | (Ωcm) | (%) | DDP |
| 45.00 | 1.00 | 2.4 | 80 | $2.3 \times 10^{13}$ | 42 | possible |
| 45.50 | 0.50 | 0.8 | 65 | $1.2 \times 10^{10}$ | 71 | possible |
| 45.95 | 0.05 | 0.6 | 17 | $6.2 \times 10^7$ | 82 | possible |
| 45.98 | 0.02 | 0.6 | 7 | $4.2 \times 10^6$ | 68 | possible |
| 45.99 | 0.01 | 0.6 | 4 | $2.8 \times 10^4$ | 45 | possible |

Figure 54:
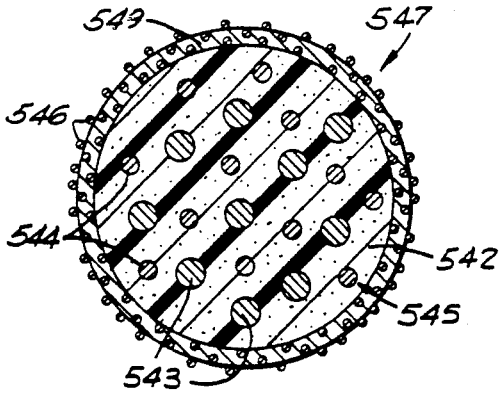
FIG. 54 is a cross-sectional view of a toner particle constructed and arranged in accordance with still another alternate embodiment of the invention.

FIG. 54 is a cross-sectional view of another toner particle 547 of the invention. Each toner particle 547 has a toner core 545 in which a magnetic agent 543, a pigment 544 and other agents are dispersed in a binding resin 542. A wax layer 549 having a thickness between about 0.1 and 0.2 μm and including a conductive agent 546 is coated on toner core 545.

A conventional thermoplastic resin can be used as binding resin 524. Such thermoplastic resins include polystyrene or copolymers thereof, polyester or copolymers thereof, polyethylene or copolymers thereof, acrylic resin and vinyl resin. Any of these resins can be used alone or in combination, preferably in an amount between about 40 and 60 wt % of the toner.

A conventional magnetic powder such as $Fe_3O_4$, $\gamma$—$Fe_2O_3$, chrome dioxide, nickel ferrite or iron alloy powder can be used as magnetic agent 543. Magnetic agent 543 is preferably used in an amount between about 40 and 80 wt %.

Pigment 544 can be selected from carbon black, spirit black, nigrosine and the like. Pigment 544 can be used in an amount between about 1 and 10 wt % of the toner. In addition, it is desirable to add between about 0.1 and 0.5 wt % of a flow promoting agent such as $SiO_2$, $TiO_2$ and the like.

The wax of wax layer 549 preferably has a viscosity that decreases rapidly at a temperature between about 40° and 50° C. Between about 30 and 70 wt % of carbon black and the like is added to the wax as a conductive agent. The carbon black is dispersed on the wax layer or on the inner side of the wax layer.

Figure 55:
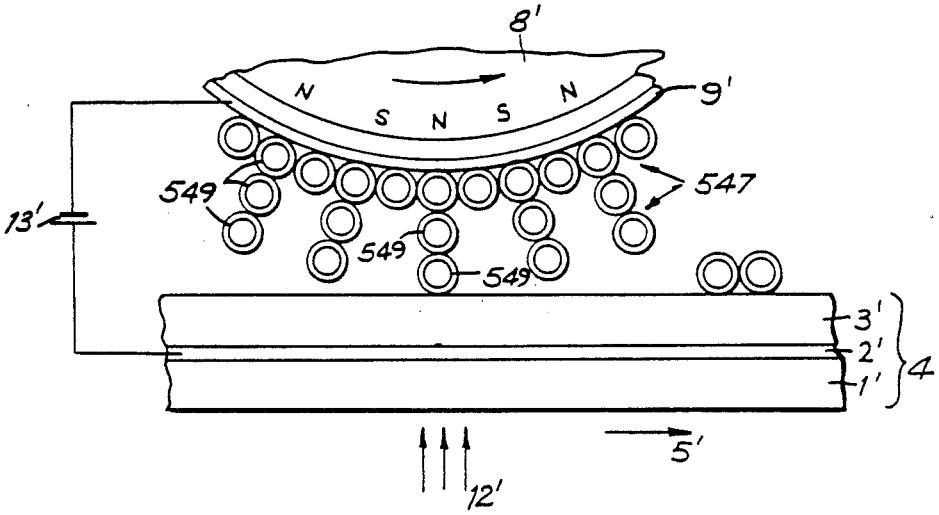
FIG. 55 is a diagram showing image formation by a direct developing process using the toner of FIG. 54 in the printer of FIGS. 2A and 2B.

Image formation by a direct developing process to image forming member 4' using the toner of FIG. 54 in printer 23' of FIGS. 2A and 2B is shown in FIG. 55. Magnetic toner particles 547 are carried by sleeve 9' and contact photoconductive layer 3' at exposed portions.

Since a bias voltage 13' is applied to sleeve 9', electric charges accumulate in toner particles 547 that are in contact with photoconductive layer 3' through conductive wax layer 549. The amount of accumulated charge is different between the exposed and unexposed portions of photoconductive layer 3' of image forming member 4'. Accordingly, the electrostatic attractivity of toner particles 547 to the surface of photoconductive layer 3' also differs. As a result, an image is formed.

Figure 56:
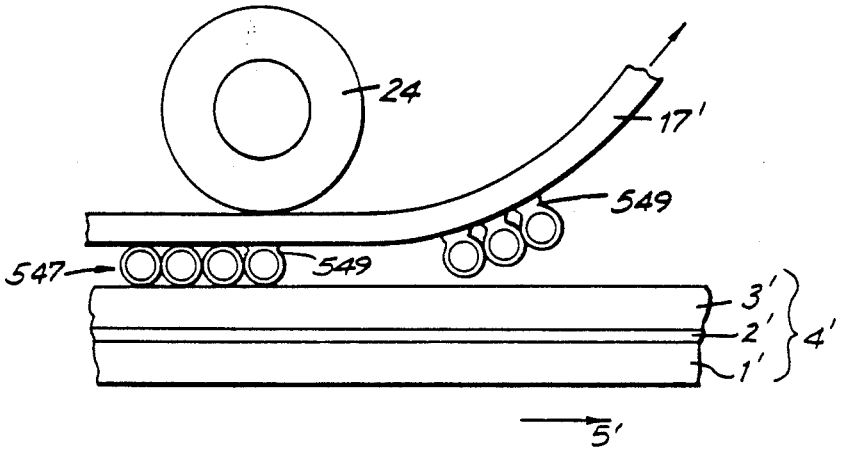
FIG. 56 is a diagram showing thermal transfer of the image formed in accordance with FIG. 55 to a recording medium.

FIG. 56 illustrates image transfer from image forming member 4' in accordance with FIG. 55 to a recording medium 17'. Recording medium 17' is placed on the surface of image forming member 4' and heated from the rear to a temperature between about 40° and 50° C. by heat roll 24. The wax on the surface of the toner is resolved and accordingly the toner is transferred to the recording medium as a result of the adhesiveness of the wax. The toner on recording medium 17' is then fixed by heat.

Toner particles 547 are formed by preparing a toner core powder having a diameter between about 10 and 15 μm by conventional kneading, grinding and classifying techniques. In addition, a wax powder is prepared from a wax including a predetermined amount of a conductive agent. The wax is cooled and ground to obtain a wax powder having a diameter between about 0.1 and 0.5 mm. The toner core powders and the wax powders are mixed and a conductive wax layer is coated on the surface of the toner core powder by a mixing treatment using a ball mill.

EXAMPLE 7-5

490 g of acrylic resin (ACRYPET, a product of Mitsubishi Kasei) used as a thermoplastic resin, 490 of $Fe_3O_4$ (EPP 2000, a product of Toda Kogyo) used as a magnetic powder and 20 g of carbon black (#44, a product of Mitsubishi Kasei) used as a conductive pigment agent were mixed and kneaded using a screw extruder. The kneaded materials were roughly ground using a stamp mill to an average size of between about 0.1 and 0.5 mm. The ground material was further pulverized using a jet mill to an average size of between about 5 and 30 μm. Finally, the materials were classified using a dry screen classifier to a size between about 10 and 15 μm in order to yield toner core particles.

Then 100 g of a wax (HNP9, a product of Nippon Seiro) and 100 g of carbon black were mixed and heated. The mixture was cooled and pulverized to obtain a wax powder. 100 g of the toner core particles and 150 g of wax powder were mixed to form one-compound magnetic toners having a wax layer coated on the surface of the core particles. Image formation, transfer and fixation were accomplished using these one-compound magnetic toners in a direct developing process and satisfactory images were obtained.

EXAMPLE 7-6

450 g of polystyrene resin (STYLON, a product of Asahi Kasei) used as a thermoplastic resin, 530 g of γ-ferric monoxide used as a magnetic powder and 20 g of nigrosine (a product of Orient Kagaku) used as a pigment were mixed and kneaded using a screw extruder. The mixture of kneaded materials was roughly ground using a stamp mill to a size between about 0.1 and 0.5 mm, finely pulverized using a jet mill to a size between about 5 and 30 μm, and classified using a dry screen classifier to a size between about 10 and 15 μm in order to yield toner core particles.

100 g of wax (HNP5, a product of Nippon Seiro), 90 g of carbon black and 10 g of fine particle silicon dioxide (a product of Aerosil) were mixed and heated. Then the heated mixture was cooled and ground to an average particle diameter between about 0.1 and 0.5 mm.

100 g of toner core particles and 150 g of wax powders were mixed and the wax layer was coated on the surface of the toner core particles in order to yield a single component magnetic toner. Image formation, transfer efficiency and fixation were accomplished using the one-compound magnetic toner in a direct developing process. Satisfactory fixed images were obtained.

Another method of preparing a toner in accordance with this embodiment includes preparation of toner core particles having a diameter between about 10 and 15 μm by conventional kneading, grinding and classification techniques. A wax is cooled and ground to obtain wax powders having a diameter less than about 0.1 mm. The toner core particles and conductive agent are agitated and mixed in a predetermined ratio. The mixed materials are injected in a hot air flow at a temperature between about 200° and 300° C. at a speed of between about 20 and 30 m/sec. Accordingly, a wax layer was coated on the surface of the toner core particles.

EXAMPLE 7-7

490 g of acrylic resin (ACRYPET, a product of Mitsubishi Kasei) used as a thermoplastic resin, 450 g of $Fe_3O_4$ (EPP 2000, a product of Toda Kogyo) used as a magnetic powder, 50 g carbon black (a product of Lion sha) used as a conductive agent and a pigment and 10 g of $SiO_2$ (a product of Aerosil) used as a flow promoting agent were mixed and kneaded using a screw extruder. The kneaded materials were ground to between about 0.1 and 0.5 mm, pulverized using a jet mill to between about 5 and 30 μm and classified using a dry screen classifier to between about 10 and 15 μm to yield toner core particles.

75 g of wax (HNP9, a product of Nippon Seiro) was cooled and ground to a wax powder having a diameter of less than 0.1 mm. 100 g of toner core particles, 75 g of wax powder and 75 g of carbon black were mixed and agitated. The mixed toner core particles and conductive wax powder were injected into a hot air flow at a temperature of 200° C. and a speed of 20 m/sec to coat the wax layer on the surface of the toner core particles and yield the one-compound magnetic toner. Image formation, transfer and fixation were achieved using the one-compound magnetic toner in a direct developing process and satisfactory images were obtained.

EXAMPLE 7-8

490 g of polystyrene resin (STYLON, a product of Asahi Kasei) used as a thermoplastic resin, 400 g of γ-$Fe_2O_3$ used as a magnetic powder and 100 g of spirit black (a product of Orient Kagaku) used as a pigment were mixed and kneaded using a screw extruder. The kneaded material was roughly ground using a stamp mill to a size between about 0.1 and 0.5 mm and finely pulverized using a jet mill to a size between about 5 and 30 μm. The materials were classified using a dry screen classifier to between about 10 and 15 μm to yield toner core particles.

50 g of wax (HNP9, a product of Nippon Seiro) wa heated, then cooled and ground to an average particle diameter of less than about 0.1 mm. 100 g of the toner core, 50 g of the wax powder and 100 g of carbon black were mixed and agitated. The mixed materials were injected in a hot air flow at a temperature of 300° C. and a speed of 30 m/sec in order to coat a wax layer on the surface of the toner core particles and yield a single component magnetic toner. Image formation, transfer and fixation were accomplished using these single component magnetic toners in a direct developing process and satisfactory images were obtained.

Figure 57:
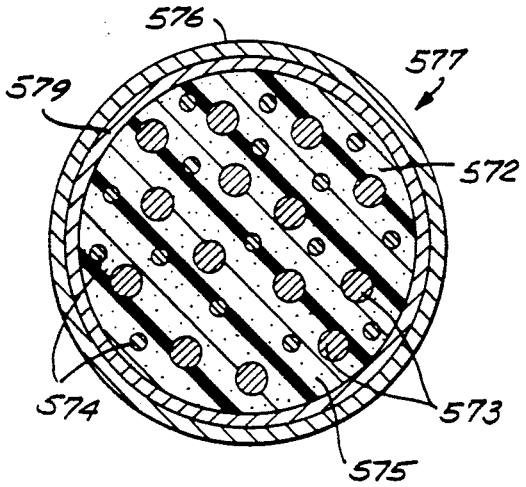
FIG. 57 is a cross-sectional view of a toner particle constructed and arranged in accordance with still a further alternate embodiment of the invention.

A toner particle 577 prepared in accordance with another embodiment of the invention is shown in FIG. 57. Toner particle 577 has a toner core 575 in which a magnetic agent 573, a pigment 574 and other agents are dispersed in a binding resin 572. A wax layer 579 having a thickness between about 0.5 and 2 μm and a low melting point was coated on toner core 575. A conductive layer 576 is coated on wax layer 579 to a thickness between about 0.1 and 5 μm.

Conventional thermoplastic resins are used for binding resin 572. Such resins include polystyrene and copolymers thereof, polyester and copolymers thereof, acrylic resin and vinyl resin. These resins can be used alone or in combination. The binding resin is preferably used in an amount between about 40 and 60% by weight of the toner.

Conventional magnetic powders such as $Fe_3O_4$, $\gamma$—$Fe_2O_3$, chrome dioxide, nickel ferrite and iron alloy powder are suitable for use as magnetic agent 573. Magnetic agent 573 is preferably used in an amount between about 40 and 80 wt %.

Pigment 574 is preferably carbon black, spirit black, nigrosine and the like used in an amount between 1 and 3 wt %. In addition, it is desirable to add between about 0.1 and 0.5 wt % of a flow promoting agent such as silicon dioxide, titanium dioxide and the like. Furthermore, it is preferable for the wax to have a viscosity that decreases rapidly at a temperature between about 40° and 50° C. Carbon black and the like having a particle diameter between about 0.1 and 0.5 μm are suitable for use as conductive agents.

Toner particles 577 are formed by preparation of core particles 575 having a diameter between about 10 and 15 μm by conventional kneading, grinding and classifying techniques. A wax having a low melting point is cooled and ground to obtain wax powders having an average particle diameter between about 0.1 and 0.5 mm. The toner core particles 575 and the wax powders are mixed using a ball mill and the wax layer is coated on the surface of the toner core. Alternatively, the wax layer can be coated on the surface of the toner core by heated air.

Figure 58:
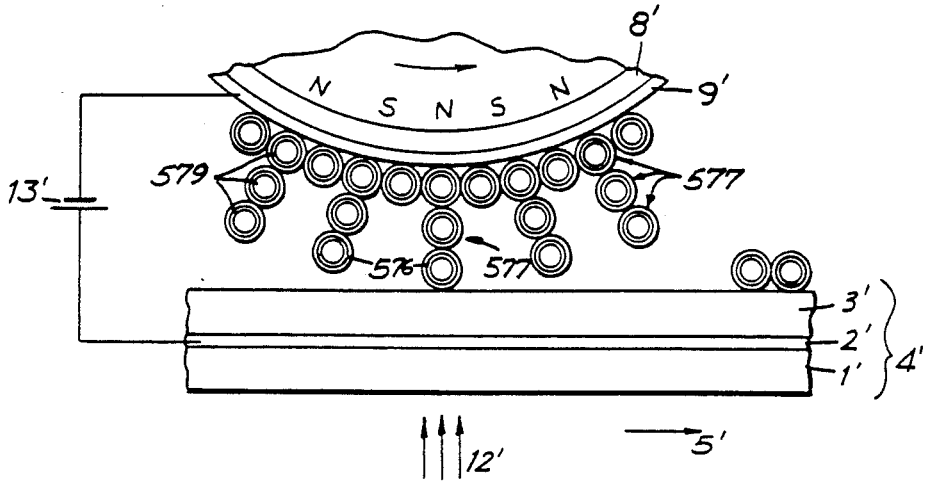
FIG. 58 is a diagram showing image formation by a direct developing process using the toner of FIG. 57 in the printer of FIGS. 2A and 2B.

Image formation on image forming member 4' by a direct developing process using toner particles 577 in printer 23' of FIGS. 2A and 2B is shown in FIG. 58. Magnetic toner particles 577 are carried by a sleeve 9' and contact photoconductive layer 3' at exposed portions.

Since bias voltage 13' is applied to sleeve 9', electric charge is accumulated in toner particles 577 that are in contact with photoconductive layer 3' through conductive wax layer 576. The amount of accumulated charge in toner particles 577 depends on whether toner particles 577 are in contact with exposed or unexposed portions of image forming member 4'. Accordingly, the electrostatic attractivity of toner 577 to photoconductive layer 3' also differs. As a result, the image is formed.

Figure 59:
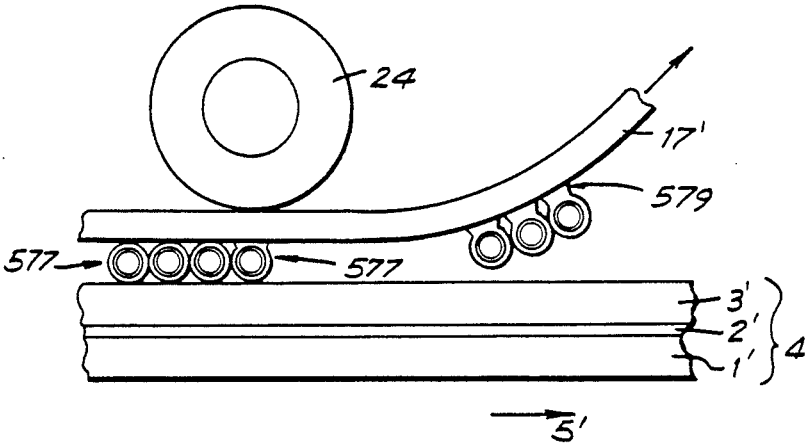
FIG. 59 is a diagram showing thermal transfer of the image formed in accordance with FIG. 58 to a recording medium.

Image transfer by a thermal transfer method from image forming member 4' prepared in accordance with FIG. 58 is shown in FIG. 59. The image is transferred by placing recording medium 17' on the surface of image forming member 4'. Recording medium 17' is heated from the rear by heat roll 24 to a temperature between about 40° and 50° C. The wax on toner particles 577 is dissolved and accordingly, the toner is transferred to recording medium 17' as a result of the adhesiveness of the wax. The transferred image is further fixed by heat.

EXAMPLE 7-9

490 g of acrylic resin (ACRYPET, a product of Mitsubishi Kasei) used as a thermoplastic resin, 450 g of $Fe_3O_4$ (EPP 2000, a product of Toda Kogyo) used as a magnetic material, 50 g of carbon black (a product of Lionsha) used as a pigment and 10 g of silicon dioxide powder (a product of Aerosil) used as a flow promoting agent were mixed and kneaded using a screw extruder. The ground materials were finely pulverized using a jet mill to between about 5 and 30 μm and classified using a dry screen classifier to between about 10 and 15 μm to yield toner core particles.

150 g of wax (HNP9, a product of Nippon Seiro) having a low melting point were cooled and ground to obtain particles having an average diameter of between about 0.1 and 0.5 mm. The ground wax and 100 g of toner particles were mixed using a ball mill to coat the wax on the surface of the toner core particles.

Single component magnetic toners were prepared by coating 10% of carbon black on the surface of the wax layer using a ball mill. The wax layer had a thickness of 1 to 2 μm and the conductive layer had a thickness of 0.1 to 0.3 μm. Image formation, transfer and fixation was accomplished using the single component magnetic toners in a direct developing process and satisfactory images were obtained.

EXAMPLE 7-10

Toner core particles were prepared as shown in Example 7-9. A wax having a low melting point (HNP9, a product of Nippon Seiro) was cooled and ground to a size of 0.1 mm. 100 g of the toner core particles and 200 g of wax powder were mixed and agitated. The mixture was injected in a hot air flow at a speed of 10 m/sec and a temperature of 50° C. to coat the way layer on the surface of the toner core particles. The wax coated on 100 g toner core particles and 20 g of carbon black were mixed and agitated thoroughly. The mixed materials were injected in a hot air flow at a temperature of approximately 70° C. and a speed of 20 m/sec. The conductive carbon black layer was coated on the surface of the wax layer to yield a single component magnetic toner. The wax layer of the single component magnetic toner had a thickness between about 1 and 2 μm and the conductive layer had a thickness between about 0.3 and 0.5 μm. Image formation, transfer and fixation was performed using these single component magnetic toners in a direct developing process and excellent fixed images were obtained.

EXAMPLE 7-11

450 g of polystyrene resin (STYLON, a product of Asahi Kasei) used as a thermoplastic resin, 530 g of $\gamma$—$Fe_2O_3$ used as a magnetic powder and 20 g of nigrosine (a product of Orient Kagaku) used as a pigment were mixed and kneaded using a screw extruder. The kneaded materials were roughly ground using a stamp mill to between about 0.1 and 0.5 mm and finely pulverized using a jet mill to between about 5 and 30 μm. The materials were then classified using a dry screen classifier to about 10 and to yield toner core particles.

100 g of a wax having a low melting point (HNP9, a product of Nippon Seiro) was cooled and ground to a size between about 0.1 and 0.5 mm to yield a wax powder. 100 g of wax powder and toner core particles were mixed to coat wax layer 579 on the surface of toner particle core 575. 100 g of coated toner core particles and 20 g of carbon black were mixed and a carbon black conductive layer was coated on the surface of the wax layer in order to yield a single component magnetic toner. These single component magnetic toners had a wax layer having a thickness of between about 0.5 and 1 μm and a conductive layer having a thickness between about 0.3 and 5 μm. Image formation, transfer and fixation were performed using these single component magnetic toners in a direct developing process and excellent fixed images were obtained.

EXAMPLE 7-12

Toner core particles were prepared as shown in Example 7-11. A low melting point wax (HNP9, a product of Nippon Seiro) was cooled and ground to yield a wax powder having a diameter of less than 0.1 mm. 100 g of the toner core particles and 250 g of wax powder were mixed and agitated. The mixture was injected into a hot air flow at a temperature of approximately 60° C. and a speed of 15 m/sec to coat a wax layer onto the surface of the toner core particles. 100 g of the coated toner particles and 30 g of carbon black were injected in a hot air flow at a temperature of approximately 80° C. and a speed of 25 m/sec and a carbon black conductive layer was coated on the surface of the wax layer. The wax layer had a thickness between about 1 and 2 μm and the conductive layer had a thickness between about 0.1 and 0.3 μm. Image formation, transfer and fixation were performed using these single component magnetic toners in a direct developing process and excellent fixed images were obtained.

COMPARATIVE EXAMPLE 7-1

Toners were made as described in Example 7-9 except that the amount of wax and carbon black were varied. Table 7-3 shows the results of varying the amount of wax and carbon black.

TABLE 7-3

| Condition | Thickness | Result |
|---|---|---|
| 200 g of wax | 2–3 μm | The image was transferred but a large amount of wax was soaked into the recording medium. |
| 50 g of wax | less than 0.5 μm | The image was not transferred. |
| 5 g of carbon black | less than 0.1 μm | The image was not formed. |
| 25 g of carbon black | 0.5 to 1 μm | The image was not transferred. |

COMPARATIVE EXAMPLE 7-2

Table 7-4 shows the results of varying the amounts of wax and carbon black in the toner of Example 7-10.

TABLE 7-4

| Condition | Thickness | Result |
|---|---|---|
| 250 g of wax | 2–3 μm | The image was transferred but a large amount of wax was soaked into the recording medium. |
| 100 g of wax | less than 0.5 μm | The image was not transferred. |
| 10 g of carbon black | less than 0.1 μm | The image was not formed. |
| 30 g of carbon black | 0.5 to 1 μm | The image was not transferred. |

COMPARATIVE EXAMPLE 7-3

Table 7-5 shows the results of varying the amounts of wax and carbon black in the toner of Example 7-11.

TABLE 7-5

| Condition | Thickness | Result |
|---|---|---|
| 200 g of wax | 2 to μm | The image was transferre but a large amount of wax was soaked into the recording medium. |
| 50 g of wax | less than 0.5 μm | The image was not transferred. |
| 5 g of carbon black | less than 0.1 μm | The image was not formed |
| 25 g of carbon black | 0.5 to 1 μm | The image was not transferred. |

COMPARATIVE EXAMPLE 7-4

Table 7-6 shows the results of varying the amounts of wax and carbon black in the toners of Example 7-12.

TABLE 7-6

| Condition | Thickness | Result |
|---|---|---|
| 300 g of wax | 2 to 3 μm | The image was transferred but a large amount of wax was soaked into the recording medium. |
| 100 g of wax 0.5 μm | less than ferred. | The image was not trans- |
| 15 g of carbon black | less than 0.1 μm | The image was not formed. |
| 35 g of carbon black | 0.5 to 1 μm | The image was not transferred |

As can be seen from the Comparative Examples, when the wax layer has a thickness greater than about 2 μm, a large amount of wax is soaked into the recording medium at the time of image transfer. Accordingly, it is not desirable to use such a wax. On the other hand, when the wax has a thickness of less than about 0.5 μm, the amount of wax transferred is not acceptable and such a wax is also not desirable.

Furthermore, when the conductive layer has a thickness of greater than about 0.5 μm, the wax does not resolve in the toner and images are not satisfactorily transferred. Finally, when the conductive layer has a thickness of less than about 1 μm, the image is not formed due to the low conductivity ratio.

Embodiment 8

The toner of this embodiment includes a binding resin consisting primarily of a thermoplastic elastomer having a conductive material dispersed therein. By using this toner in a direct developing process, electric charge is accumulated in the toner that is in contact with the surface of an image forming member by application of pressure to the toner during image formation. As a result, the resistance of the toner is decreased and the toner particles become conductive. When the image is transferred, toner particles to which pressure has not been applied have an insulating property and are electrostatically transferred to the image forming member.

Figure 60:
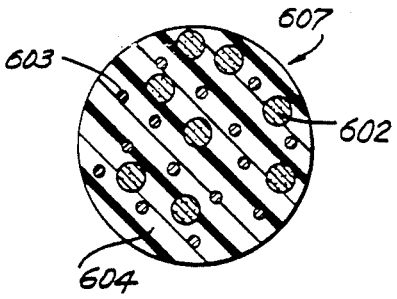
FIG. 60 is a cross-sectional view of another toner particle constructed and arranged in accordance with yet another alternate embodiment of the invention.

A toner particle 607 prepared in accordance with this embodiment including a binding resin 604 composed of a thermoplastic elastomer and a conductive material 603 and a magnetic powder 602 dispersed in resin 604 is shown in FIG. 60. Thermoplastic elastomer 604 is flexible and elastic at ambient temperatures and preferably has a melting point of approximately 100° C. Suitable thermoplastic elastomers include EVA resin, polyurethane, copolymers of styrene-butadiene, polyester and copolymers thereof and polyethylene and copolymers thereof. Such elastomers can be used alone or in combination. Binding resin 604 is preferably used in an amount between about 40 and 60% by weight.

Magnetic powder 602 can be any suitable magnetic agent such as tetroxide iron, $\gamma$—$Fe_2O_3$, chromium dioxide, nickel ferrite and iron alloy powder used in an amount of between about 40 and 80% by weight. A known carbon is preferably used in an amount between about 1 wt % and 5 wt % as a conductive material.

Figure 61:
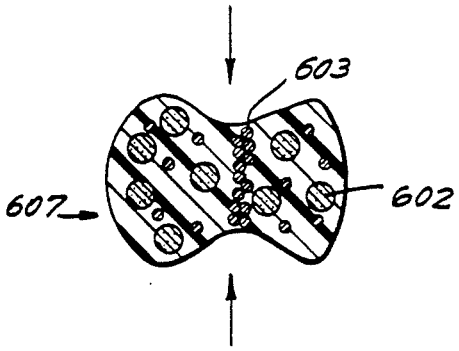
FIG. 61 is a cross-sectional view showing preparation of the toner of FIG. 60.

A toner core powder 604 having a diameter between about 10 and 15 μm is prepared by conventional kneading, grinding and classification techniques. The toner particle configuration at the time of formation is generally as shown in FIG. 61. When pressure is applied to a binding resin that is flexible at ambient room temperature, only the pressurized portion is configured. Accordingly, the conductive particles dispersed in the resin are close together in the pressurized portion and a chain of conductive particles is formed. As voltage is applied between a magnetic sleeve and a photoconductive layer under pressure during formation of the toner compound, the toner in the magnetic brush is connected to both, and, therefore, the electric charge can accumulate. As a result, the charge accumulates.

Figure 62:
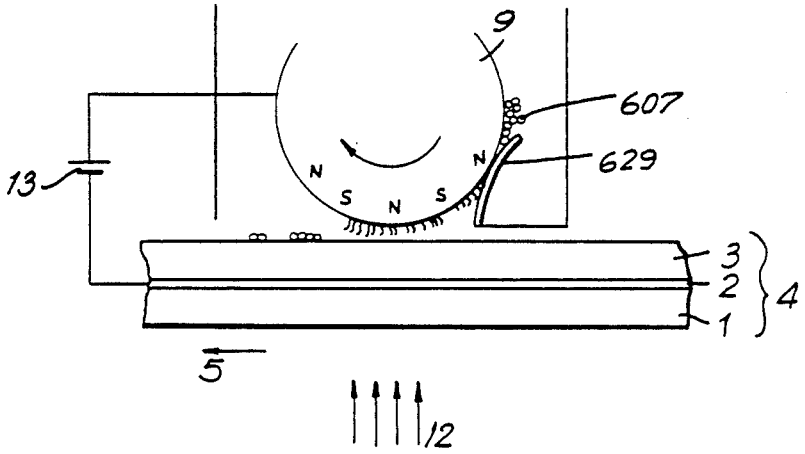
FIG. 62 is a diagram showing image formation by a direct developing process using the toner of FIG. 60 in the printer of FIGS. 1A and 1B.

Image formation using the toner of FIG. 60 in printer 23 of FIGS. 1A and 1B is shown in FIG. 62. When toner 607 was supplied from a toner reservoir, pressurization was applied to the toner formed on the magnetic brush by utilizing a compression blade 629. Image forming member 4 is subjected to image exposing light 12. During this period, if bias voltage is applied between sleeve 9 and photoconductive layers 3, charges accumulate in the toner attached to photoconductive layer 3 through conductive particles that form a conductive chain as the result of pressure. The amount of accumulated charge is different between exposed and unexposed portions of photoconductive layer 3. Therefore, the electrostatic attractivity of the toner to the surface of photoconductive layer 3 differs between these portions and an image is formed.

The toner image on the photosensitive drum becomes insulative again as a result of decreased pressure during rotation of the belt. Accordingly, the image is copied onto plain paper by a general electrostatic transfer method. Thereafter, the image is fixed by a heat fixing roller.

EXAMPLE 8-1

495 g of EVA resin (EV 40, a product of Mitsui Dupon Polychemical) used as the thermoplastic resin, 495 g of $Fe_3O_4$ (EPP 2000, a product of Toda Kogyo) used as the magnetic powder and 10 g of carbon black (#44, a product of Mitsubishi Kasei) used as the conductive particle were mixed and kneaded using a screw extruder. The kneaded materials were roughly ground to a size between about 0.1 and 0.5 mm using a stamp mill and then finely pulverized to between about 5 and 30 μm. The pulverized materials were then classified using a dry screen classifier to a size between about 10 and 15 μm to yield the toner.

Pressurization and conductivity tests were conducted using these toners in a cylindrical cell having an inner diameter of 3 mm. At a pressurization of 500 g/cm$^2$, the specific resistance was $10^8\Omega$ cm. Without pressurization, the specific resistance was $10^{13}\Omega$ cm. Image formation, transfer and fixation experiments were conducted using a direct developing process and satisfactory fixed images were obtained.

EXAMPLE 8-2

A toner was preparing using a copolymer of ethylene and α-olefin (a product of Mitsui Sekyu Kagaku), which has a higher melting point and a stronger elastic force than the EVA resin of Example 8-1, as the thermoplastic resin. The toner was prepared as described in Example 8-1.

Since the binding resin had excellent weather, chemical and heat resistance, distinct images were formed even when the toner was recycled.

EXAMPLE 8-3

Printing conditions were affected by the type of thermoplastic elastomer used as the binding resin. Table 8-1 shows experimental data using seven thermoplastic elastomers having different melting points and hardness. The toners used in these experiments were all prepared as in Example 8-1.

TABLE 8-1

| | Melting point (°C.) | Hardness Degree | Material | Condition |
|---|---|---|---|---|
| Example No. | | | | |
| 8-3 | 60 | 60 | EVA | |
| 8-4 | 90 | 60 | Olefin | |
| 8-5 | 120 | 80 | Olefin | |
| Comparative Example No. | | | | |
| 8-1 | 45 | 60 | EVA | × |
| 8-2 | 70 | 100 | EVA | × |
| 8-3 | 90 | 40 | Olefin | × |
| 8-4 | 160 | 60 | EVA | × |

= distinct image
= fine image
× = foggy image

In a direct developing process using a binding resin wherein the rate of conductivity is changed as a result of pressure, the melting point of the resin is preferably between about 50° and 150° C. and more preferably, between about 70° and 100° C. The degree of hardness is between about 50 and 90 and more preferably, between about 50 and 70. When the melting point of the material is less than about 50° C., the material is cohered. When the melting point is greater than about 150° C., the resolution decreases and a large scale fixing device is required. Furthermore, a resin having a degree of hardness less than about 50 has a low elasticity. Resins having a degree of hardness of greater than about 90 are not suitable due to the pressure requirements. Accordingly, these resins are not suitable for image formation and are affected by the printed matter which causes a deterioration in resolution.

Image transfer experiments were conducted on 10,000 sheets of A-4 plain paper utilizing the toners of these examples. As a result, excellent images were obtained without fogging.

The toners prepared in accordance with the invention including a conductive portion and an insulating portion. The conductive portion facilitates charge accumulation and the insulating portion slows the rate of discharge of the accumulated charge. Such toners provide for improved image transfer in printers utilizing xerography techniques to print images. These toners are useful in direct developing processes and enable image transfer to be simplified as compared with prior art xerography processes. Accordingly, printer size and cost can be minimized.

The image forming members of printers that use these toners can have a seam. However, when the length of the image forming member is short, the image forming member can be provided without a seam. Accordingly, printer size can be minimized.

In addition, a conductive fiber or magnetic fiber brush is suitable as a toner carrying means. The toners are not necessarily magnetic and accordingly, magnetic rollers are not always necessary. Elimination of the magnetic roller reduces the printer cost. A thin film layer having appropriate electrical resistance values and mechanical strength can be coated on the surface of the image forming member. Such a coating improves the durability of the printing and the stability of image formation. When the mixed conductive and insulating toners are used, it is not necessary to add the dyeing agent. It is only necessary to add the dyeing agent in both the conductive toner and the insulating toner for seeing the image. It is only necessary to add the dyeing agent to at least an electrostatic transferred toner.

It will thus be seen that the objects set forth above, among those made apparent from the preceding description, are efficiently attained and, since certain changes may be made in carrying out the above process, in the described product, and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. An image forming device adapted to print images using a xerography technique, said image forming device comprising at least a toner reservoir having toner dispersed therein, said toner including conductive portions and insulative portions, said conductive portions being adapted to accumulate a charge in the toner with a predetermined period of discharge and said insulative portion having adapted to lengthen the period of discharge of the accumulated charge, wherein said conductive portions include semiconductor material.

2. The device of claim 1, wherein the conductive portion is a P type semiconductor.

3. The device of claim 1, wherein the conductive portion is a N type semiconductor.

4. The device of claim 1, wherein each toner particle further includes a magnetic material dispersed in the insulating portions.

5. The device of claim 1, wherein the insulating portions have a volume resistance of greater than about $10^8\Omega$ cm.

6. The device of claim 1, wherein each toner particle includes an insulating resin core and a photoconductive agent covering the core.

7. The device of claim 6, wherein the core is formed of a binding resin.

8. The device of claim 6, wherein the resin core further includes a dyeing agent dispersed therein.

9. The device of claim 6, wherein the resin core further includes a magnetic material dispersed therein.

10. The device of claim 7, wherein the resin core is a thermoplastic resin.

11. A method of forming an image comprising:

selectively exposing an image forming member having a photoconductive layer;

contacting said image forming member with a toner layer at substantially the same time as the image forming member is exposed, said toner layer comprising conductive portions and insulative portions, said conductive portions being adapted to accumulate a charge in the toner layer with a predetermined period of discharge and said insulative portion being adapted to lengthen the period of discharge of the accumulated charge;

applying an electric field to the toner layer on the image forming member so as to selectively attach toner particles to the image forming member to form an image; and electrostatically transferring the toner image on the image forming member to a recording medium.

12. A method of preparing a toner particle comprising:

forming conductive resin bars of a conductive resin;

forming insulative resin bars of an insulative resin;

alternately bundling the conductive resin bars and the insulative resin bars;

stretching the bundled bars to form a thread; and pulverizing the thread to a predetermined particle diameter.

13. A method of preparing a toner particle comprising:

providing a conductive material having a foaming agent having a decomposition temperature higher than the melting point of the conductive material at a concentration between about 0.2 and 10 wt %;

heating the conductive material having foaming agent to produce foams; and filling the foam with an insulating material.

14. A method of preparing a toner particle comprising:

dispersing conductive thermoplastic resin particles in a heat resistive solution maintained at a temperature higher than the melting point of the thermoplastic resin;

passing the thermoplastic resin particles through a space smaller than the particle diameter of the resin particle;

quenching the thermoplastic resin particles immediately after passing through the space; and partially attaching an insulating resin particle on the surface of the thermoplastic resin particle.

15. An image forming device, comprising a toner reservoir having a toner particles dispersed therein, said toner having conductive portions and insulating portions, said conductive portions being adapted to accumulate a charge in the toner with a predetermined period of discharge and said insulating portion being adapted to lengthen the period of discharge of the accumulated charge, image forming means including a photoconductive layer, means for contacting the toner layer with said image forming member at the opposite side to the exposed side for forming an image upon exposure substantially simultaneously with the exposure, electric field means for applying an electric field to said photoconductive layer and said toner, wherein the toner particles are selectively attached to said image forming member to form an image, and electrostatic transfer means for transferring said toner image from said image forming member to a recording medium.

16. An image forming device adapted to print images using a xerography technique, said image forming device comprising at least a toner reservoir having a toner dispersed therein, said toner including conductive portions and insulative portions, said conductive portions being adapted to accumulate a charge in the toner with a predetermined period of discharge and said insulative portion being adapted to lengthen the period of discharge of the accumulated charge, wherein said toner is formed of a thermoplastic elastomer resin including a conductive material dispersed therein.

17. The device of claim 16, wherein magnetic particles are dispersed into thermoplastic elastomer resin.

18. The device of claim 16, wherein the thermoplastic resin has a melting point between 50° C. and 150° C. and degree of hardness of between about 50 and 90.

19. A printing method employing a xerography process utilizing toners formed of conductive portions and insulative portions to print images, said printing method comprising:

preparing said toner including a thermoplastic elastomer resin, dispersing conductive material in said toner, applying pressure to said toner at the time of the development, thereby gathering said conductive material and supplying charges and releasing the pressure applied to the toner at the transfer, to restore the conductive property of the toner, thereby said toner is transferred to a recording medium.

* * * * *